US006036009A

United States Patent [19]

Kim

[11] Patent Number: 6,036,009

[45] **Date of Patent: *Mar. 14, 2000**

[54] JUNIOR AND FULL SIZED GOLF BAG

[76] Inventor: Jin C. Kim, 8161 8th St., No. 6, Buena Park, Calif. 90621

[ * ] Notice: This patent is subject to a terminal disclaimer.

[21] Appl. No.: 09/023,997

[22] Filed: Feb. 14, 1998

Related U.S. Application Data

[63] Continuation-in-part of application No. 08/951,655, Oct. 16, 1997, which is a continuation-in-part of application No. 08/838,740, Apr. 11, 1997, Pat. No. 5,845,773, which is a continuation-in-part of application No. 08/740,193, Oct. 24, 1996, Pat. No. 5,785,173, which is a division of application No. 08/561,896, Nov. 22, 1995, Pat. No. 5,573,112.

[51] Int. Cl.[7] ..... A63B 55/00

[52] U.S. Cl. ..... 206/315.3; 206/315.6; 206/315.8

[58] Field of Search ..... 206/315.3–315.6, 206/315.8

[56] References Cited

U.S. PATENT DOCUMENTS

| | | | |
|---|---|---|---|
| D. 386,303 | 11/1997 | Wang | D3/255 |
| 1,092,729 | 4/1914 | Low et al. . | |
| 1,227,657 | 5/1917 | Pierce | 206/315.6 |
| 1,236,313 | 8/1917 | Keblinger . | |
| 1,726,245 | 8/1929 | Shelton | 206/315.6 X |
| 1,788,478 | 1/1931 | Beaty et al. | 206/315.6 |
| 1,798,638 | 3/1931 | Stone et al. | 206/315.6 |
| 1,809,536 | 6/1931 | Tucker | 206/315.6 |
| 1,840,183 | 1/1932 | Blich | 206/315.6 |
| 2,009,072 | 7/1935 | Sampson | 206/315.6 X |
| 2,023,792 | 12/1935 | Sampson | 206/315.6 X |
| 2,256,521 | 9/1941 | Kirkpatrick et al. | 206/315.3 |
| 2,294,084 | 8/1942 | Gihon, III et al. | 206/315.6 |
| 2,546,416 | 3/1951 | Alter et al. | 206/315.6 |
| 2,568,810 | 9/1951 | Kish, Jr. | 206/315.6 |
| 2,752,973 | 7/1956 | Stamp | 206/315.6 |
| 3,177,913 | 4/1965 | Kish, Jr. | 206/315.3 X |
| 3,230,992 | 1/1966 | Kish, Jr. | 206/315.3 X |
| 3,455,358 | 7/1969 | Kuzma | 206/315.6 |
| 3,674,072 | 7/1972 | Shuto | 206/315.6 |

(List continued on next page.)

FOREIGN PATENT DOCUMENTS

| | | | |
|---|---|---|---|
| 216273 | 10/1955 | Australia . | |
| 274182 | 11/1966 | Australia | 206/315.4 |
| 481773 | 3/1952 | Canada . | |
| 428118 | 8/1911 | France | 206/315.5 |
| 1479 | of 1905 | United Kingdom | 206/315.5 |
| 8333 | of 1911 | United Kingdom | 206/315.5 |
| 349310 | 5/1931 | United Kingdom | 206/315.5 |
| 705115 | 3/1954 | United Kingdom | 206/315.5 |
| 2130102 | 5/1984 | United Kingdom | 206/315.6 |

OTHER PUBLICATIONS

"Golf Shop Operations", a Golf Digest Publication, Apr. 1990, "Organizer" on p. 124 sold by QS.

*Primary Examiner*—Sue A. Weaver
*Attorney, Agent, or Firm*—Curtis L. Harrington

[57] ABSTRACT

A golf bag has a configuration is particularly suited for a junior bag, but which can be employed on adult sized bags. A series of fill or partial length dividers loop against a soft, pliable layer with attachment of adjacent dividers in a close relationship, the adjacent dividers also attached to each other along their length to control the shape of a central pocket. Embodiments for four, five, six and seven dividers are disclosed. At the upper end of an inner divider section, an annular stabilization ring is made more stable by a collar ring and its covering material, which is attached both to the stabilization ring and to an upper structure of a golf bag. A rigid outer sleeve may be used to orient the soft pliable material within the golf bag, or a planar expanse of material attached to cover the bottom of the soft pliable layer of material. Alternate shapes for both inner and outer sections include round, oval, ham shaped and rectangular.

40 Claims, 14 Drawing Sheets

U.S. PATENT DOCUMENTS

| | | | |
|---|---|---|---|
| 3,729,036 | 4/1973 | McFadden . | |
| 4,172,484 | 10/1979 | Henning | 206/315.6 |
| 4,249,586 | 2/1981 | Setani | 206/315.5 X |
| 4,311,178 | 1/1982 | Kennedy | 206/315.6 |
| 4,691,823 | 9/1987 | Pape | 206/315.6 |
| 4,709,814 | 12/1987 | Antonious | 206/315.6 X |
| 4,911,292 | 3/1990 | Airey, Jr. | 206/315.3 |
| 5,088,600 | 2/1992 | Kopp. Jr. | 206/315.6 X |
| 5,103,974 | 4/1992 | Antonious | 206/315.6 |
| 5,148,915 | 9/1992 | Ryan | 206/315.6 |
| 5,226,533 | 7/1993 | Antonious | 206/315.6 |
| 5,255,781 | 10/1993 | Dulyea | 206/315.6 |
| 5,279,414 | 1/1994 | Brasher | 206/315.6 |
| 5,392,907 | 2/1995 | Blanchard et al. | 206/315.6 |
| 5,402,883 | 4/1995 | Shin | 206/315.6 X |
| 5,431,278 | 7/1995 | Gretz | 206/315.6 |
| 5,447,228 | 9/1995 | Hodgson, III | 206/315.6 X |
| 5,505,300 | 4/1996 | Joh | 206/315.6 |
| 5,573,112 | 11/1996 | Kim | 206/315.6 |
| 5,662,058 | 9/1997 | Wang | 206/315.6 X |
| 5,671,843 | 9/1997 | Sutter | 206/315.6 |
| 5,785,173 | 7/1998 | Kim | 206/315.6 |
| 5,806,675 | 9/1998 | Kim | 206/315.6 |
| 5,845,773 | 12/1998 | Kim | 206/315.6 |

175
81
85
87
89
105
63

151
81
85
87
89
105
63
153
141
141
67
141
67

133
81
85
87
89
105
63
137
139
145
147
67
135
135
67
141
67

JUNIOR AND FULL SIZED GOLF BAG

RELATED APPLICATIONS

This patent application is a Continuation-In-Part of co-pending U.S. patent application Ser. No. 08/951,655 filed Oct. 16, 1997 which is a Continuation-In-Part of U.S. patent application Ser. No. 08/838,740 filed on Apr. 11, 1997, U.S. Pat. No. 5,845,773, which is C.I.P. of U.S. patent application No. 08/740,193 filed on Oct. 24, 1996, now U.S. Pat. No. 5,785,173, which was a Divisional of then U.S. patent application Ser. No. 08/561,896, filed on Nov. 22, 1995, which matured into U.S. Pat. No. 5,573,112.

FIELD OF THE INVENTION

The present invention relates to the field of sporting goods and equipment. More specifically, the present invention relates to a relatively smaller diameter and slightly shorter golf bag for younger players commonly known as a junior bag and which incorporates a special divider configuration offering varying degrees of full length protection for shorter golf clubs used by smaller golfers.

BACKGROUND OF THE INVENTION

Conventional golf bags, both full size and junior size, have a central containment volume in the form of an elongate cylindrical space. Typically the top or entrance of the golf bag may be reinforced with structures tending to divide only the entrance of the contained volume. While a subdivision of only the entrance of the golf bag helps to protect the club heads to a degree, the club shafts within the bag are free to bump and scratch each other. Further, the extent of the subdivision of the space at the entrance of the golf bag is typically limited to three or six openings for larger bags, and typically one or two openings for junior bags. This number does not provide even separation of the clubs, which must be stored at least two clubs per opening. The opening subdivision structure also tends to have thick dividing members which restrict the entrance opening into the golf bag. Consequently a larger number of small subdivided spaces equates to a lesser overall opening space into the golf bag.

Many prior golf bags have attempted division of the bag space, but none have been as effective as shown in the types of techniques illustrated in U.S. Pat. No 5,573,112 issued to Jin C. Kim. In it, the sub divisions are arranged for efficient manufacture and to provide a stable support for the space subdivided within a golf bag. Efficient division of the space within a golf bag should provide for even division of the cross sectional entrance area, as well as result in an even balance of the golf clubs carried within the bag. The Jin C. Kim bag enabled full-length protection for clubs in a full sized bag, combined with an ultra light weight.

Other configurations and combinations are needed in order to provide a wider variety of efficient subdivisions of the golf bag area while also accomplishing other goals as well. These goals include sufficient support at the bag entrance of the upper divisions, as well as between the individually divided portions. Other problems to be solved, even with junior sized bags, include the provisions of dividers in conjunction with bag stands and the provision of bags intended to be carried on the shoulder and which will assume a narrow middle dimension when carried from the shoulder, limited only by the number and disposition of clubs carried within the bag.

The size of the junior bag presents other problems. It is significantly smaller in open area, anywhere from just less than half to ⅜ of the open area, based upon a junior bag diameter of six inches and an adult bag diameter of from eight to ten inches. The height may be anywhere from a height just short of that of a conventional sized bag to about 80% of the size of a conventional bag, based upon a conventional bag height of about thirty five inches and a height of a junior. The more narrow tubular configuration makes it more difficult to attempt to form dividers, and even more difficult to include both central crossing dividers in addition to side dividers. With a significantly reduced diameter, the same side pocket and crossing dividers not only take up too much of the available cross sectional area, but are much more difficult to sew and work into a bag structure. This is a particular problem at the collar where not only the divider material is present, but also collar reinforcing material.

SUMMARY OF THE INVENTION

The golf bag has a configuration particularly suited for a junior bag, but which can be employed on adult sized bags. A series of full or partial length dividers loop against a soft, pliable layer with attachment of adjacent dividers in a close relationship, the adjacent dividers also attached to each other along their length to control the shape of a central pocket. Embodiments for four, five, six and seven dividers are disclosed. At the upper end of an inner divider section, an annular stabilization ring is made more stable by a collar ring and its covering material, which is attached both to the stabilization ring and to an upper structure of a golf bag. A rigid outer sleeve may be used to orient the soft pliable material within the golf bag, or a planar expanse of material attached to cover the bottom of the soft pliable layer of material. Alternate shapes for both inner and outer sections include round, oval, ham shaped and rectangular.

Other features include a bag having a raised circular guard to expand the height at which a strap may be attached, a boot and reinforcing ring to make sturdy the bottom of the golf bag, and both reinforcing material and a reinforcing structure which may be carried to the side of or within the reinforcing material.

BRIEF DESCRIPTION OF THE DRAWINGS

The invention, its configuration, construction, and operation will be best further described in the following detailed description, taken in conjunction with the accompanying drawings in which.

DESCRIPTION OF THE PREFERRED EMBODIMENT

Figure 1:
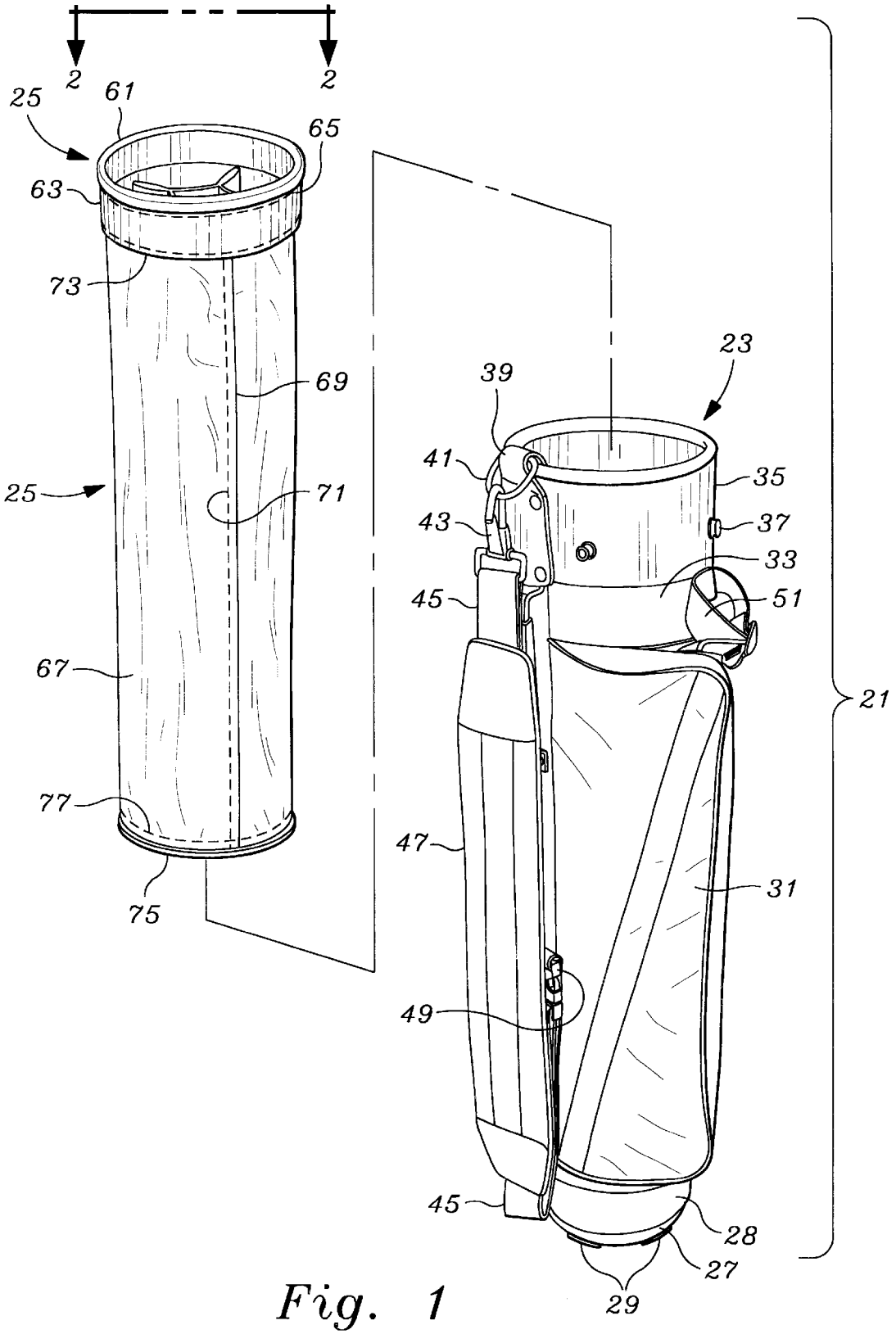
FIG. 1 is a perspective exploded view of a first embodiment of the golf bag of the present invention and illustrated with the inner section removed from and seen to the side of the main golf bag outer section.

The description and operation of the invention will be best described with reference to FIG. 1. FIG. 1 is an exploded view of a golf bag 21 of the present invention which generally includes an outer section 23 and an inner section 25. The golf bag housing or outer section 23 can be merely a shell, or a bag having a series of outer pockets and other structures.

The outer section 23 has a cup shaped base or boot 27, located below a reinforcement ring 28 and which may have a series of short legs 29 distributed about the bottom periphery of the boot 27. A large tangentially emerging storage pouch 31 extends from the body of the outer section 23. At the top of outer section 23, and attached to a main body portion 33 is a service ring 35. The service ring 35 has a series of utility snaps 37, and also supports a "D" ring strap 39 supporting a "D" ring 41. To the "D" ring 41 a shoulder strap fitting 43 supports a shoulder strap 45 which may have a padded portion 47. Strap 45, at its lower extent may have a snap fitting 49 which attached to the main body 33 of the outer section 23 of the golf bag 21. The main body 33 of the golf bag 21 may also support a utility strap 51 which is used to attach the golf bat 21 to other structures, or to carry golf towels or to attach it to a hand cart.

The inner section 25 has an annular collar ring portion 61 and a stabilization ring 63. The annular collar ring 61 is made up of an outer layer which envelops a metal ring with material folded inside the ring and folded outside the ring attached together to make an abbreviated annular cylinder extending axially away from the ring. This "tail" or downwardly extending length of material 65 is the preferred structure through which the annular collar ring portion 61 is attached to one end of the abbreviated length, but axially elongate annular stabilization ring 63.

The metal ring of the collar ring can be of any cross sectional configuration to interfit with the inner section 25 or outer section 23 of a golf bag. The cross sectional area and shape can be varied to accommodate other features of the top of, for example, the abbreviated length axial stabilization ring 63. The annular collar ring portion 61 could also be used in an oval cross sectional shape wider than axially long, to form a "lock ring" within an outer portion 23 having a lock ring groove.

As can be seen, at least for the embodiment shown in FIG. 1, a pliable, or soft surrounding layer 67 forms the body of the divider and has an elongate closure edge 69 which is secured by a closure stitch 71. The annular stabilization ring 63 is also seen as being attached adjacent a top edge of the soft surrounding layer 67 by way of a stitch 73.

At the very bottom of the inner section 25 is a planar expanse of material 75 which is attached to the soft surrounding layer 67 by way of a stitch 77. The bottom of the planar expanse of material 75 may be attached to the inside of the boot 27 by any number of methods, a few of which will be shown.

Figure 2:
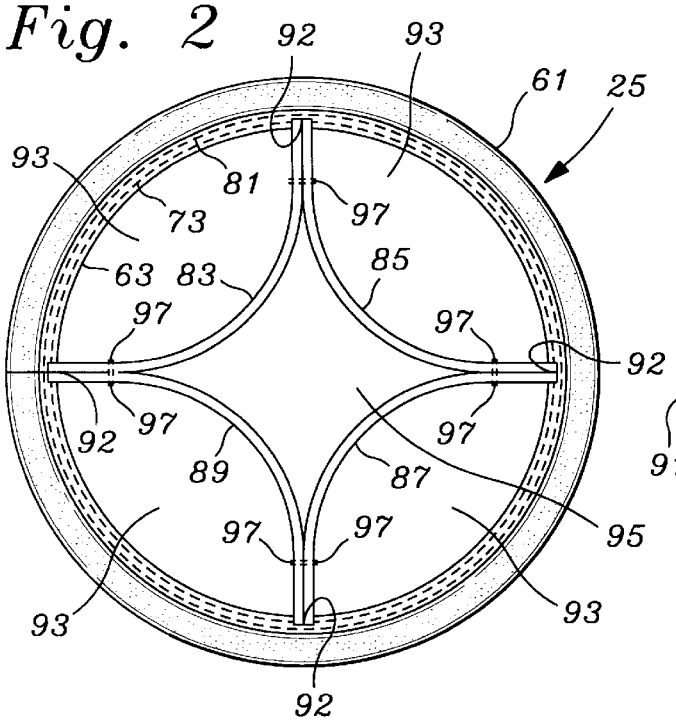
FIG. 2 is a downward view into the golf bag divider which was shown in FIG. 1, and as can be seen there are five formed compartments, resulting from four looping or curved pockets extending from the sides of the divider.

Referring to FIG. 2, a top view of the inner section 25 is seen. The smooth covered area of the annular collar ring 61 is seen, as is a first anchoring stitch 81 which holds the annular collar ring onto the annular stabilization ring 63, as well as the stitches 73 which connect the upper portion of the soft surrounding layer 67 to the annular stabilization ring 63.

In FIG. 2, and to eliminate confusion, the portion of the inner section 25 below the annular stabilization ring 63 is not shown. The most prominent structures within the annular collar ring portion 61 include a series of four dividers 83, 85, 87, & 89. Each of the four dividers 83, 85, 87, & 89 have a first end or side edge and a second side end or edge 91 (best seen in FIG. 3) which may overlap and be secured to the soft surrounding layer 67, or to the annular stabilization ring 63.

Where the four dividers 83, 85, 87, & 89 are provided with a top reinforcing material, as will be shown, the reinforcing material may be provided as a continuous length and its folds being sewn to the stabilization ring 63 with a stitch 92.

The dividers 83, 85, 87, & 89 may be supplied separately and sewn in a single operation which attaches any two adjacent ones of the dividers 83, 85, 87, & 89 along their lengths and to a soft, pliable layer, as will be shown. In the alternative, the 83, 85, 87, & 89 may be provided as a single length of material which is sharply folded at the stitch 92 and brought out in the same fashion as seen in FIG. 2, and may be joined for a distance along their length to produce the fanciful pattern of FIG. 2. When the term "divider" is used in this application it refers to either or both of an identified section of a continuously extending divider or to separate portions sewn together. It is also possible that a divider may be made from two lengths of cloth sewn or otherwise joined together along its length where a continuous extent of material is not available. The structures set forth as "divider" are meant to identify a geometrically recognizable structure, but are not limited to the component parts from which it is made, nor whether its extent is a component part of other recognizable structure identifiable as a divider.

Each of the four dividers 83, 85, 87, & 89 and a length of attachment near a side edge 91 attached to and extend from the annular stabilization ring 63 in a direction toward the center of the inner section 25, but begin curving immediately. The curvature continues through a 90° angle and terminating at a second side edge 91, with attachment immediately adjacent the side edge 91 and to the annular stabilization ring 63. Each of the four dividers 83, 85, 87, & 89 forms a storage pocket or side pocket 93. Each of the side pockets 93 define or form a central storage pocket or central pocket 95.

The shape of the central pocket 95 is assisted by stitches 97 between adjacent ones of the four dividers 83, 85, 87, & 89 to prevent the shape of the dividers from being compressed due to any clubs creating force at the apex of the legs of the star shaped central pocket 95. The distance of the stitch 97 from the annular stabilization ring 63 helps define the overall shape of the central pocket 95. Stitches 97 farther from the annular stabilization ring 63 makes each of the four dividers 83, 85, 87, & 89 assume a more angular shape, and makes the central pocket 95 smaller and less curving. The resulting fanciful pattern is symmetrical.

Figure 3:
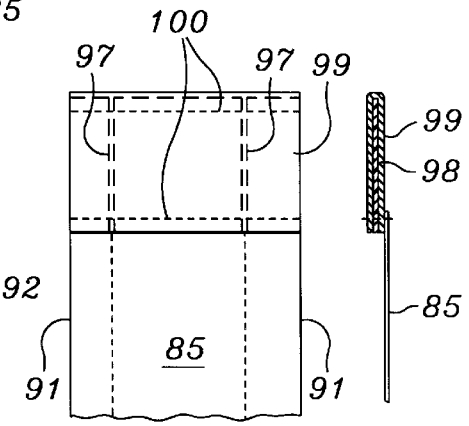
FIG. 3 is a typical length of material which is incorporated into the golf bag of the present invention and is shown being fitted at its upper end with a fold of reinforcing material.

Referring to FIG. 3, a single one of the dividers, in this case divider 87 is shown. Within the divider, a thin length of a polymeric reinforcement member 98 is seen in the side sectional view of FIG. 3. The reinforcement member 98 has an upper small piece of "U" shaped, outwardly lying reinforcing material 99 is stitched to the top of divider 87 with horizontal stitches 100. The vertically shown stitches 97 are stitches seen in FIG. 2 which help join the four dividers 83, 85, 87, & 89 and help control the shape of the central pocket 95. This is not seen in FIG. 2, for clarity, but it is included in the thickness of the divider seen in FIG. 1. The reinforcing material 99 may be felt or corduroy or other aesthetically pleasing material. The purpose of the reinforcing material 99 is twofold. First, it provides some stiffening and reinforcing influence on the top of the divider group. Secondly, it can provide a finishing layer which will give an improved appearance to the fanciful pattern best seen in FIG. 2.

In FIG. 3, the divider 83 is shown as being sewn to one side of the sandwiched polymeric reinforcement member 98 covered with reinforcing material 99. In the alternative, divider 83 can be inserted between either side of the reinforcement member 98 and the opposing side of the reinforcing material 99.

Figure 4:
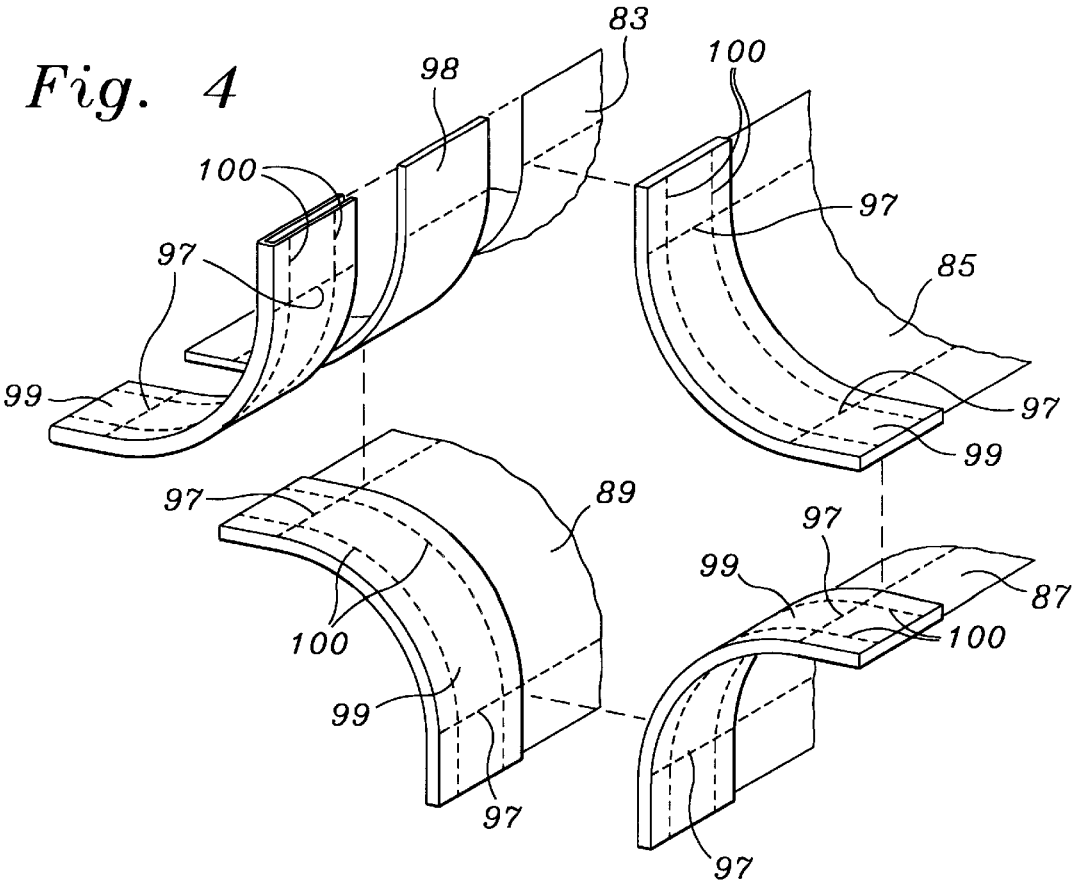
FIG. 4 illustrates a perspective end view of the segments which are joined together to form the divider system shown in FIGS. 1 and 2.

Referring to FIG. 4, an exploded perspective view of the ends of the four dividers 83, 85, 87, & 89 is shown. The lengths of reinforcing material 99 will be sewn separately to its associated divider 83,185, 87, or 89, or as shown in FIG. 2, the reinforcing material 99 may be provided as a continuous length, capturing only slightly spaced apart polymeric reinforcement members 98, with the very slight spacing between the polymeric reinforcement members 98 used to sew the reinforcing material 99 to the stabilization ring 63 as is shown in FIG. 2. In other cases, including the further embodiments shown, the reinforcing material 99 can be separately provided, and having separate ends which are sewn by stitch 92 from the side adjacent those ends.

The same holds true for the four dividers 83, 85, 87, & 89. The four dividers four dividers 83, 85, 87, & 89 can be provided as one continuous width of material where the ends of each divider is continuous with the end of the adjacent divider. Only one of the divider boundaries, representing the ends of the continuously extending width of divider which meet at one seem, would need to be joinably sewn from the side. Even where one or both of the reinforcing material 99 or the four dividers 83, 85, 87, & 89 are continuous, the appearance looking down into the inner section 25 would appear similar or the same to that of FIG. 2 because of the slight spacing between the polymeric reinforcement members 98. This spacing gives just enough clearance to make the stitch, and such that the adjacent portions of the reinforcing material 99 will spring back from an open position to a closure position over the stitch, as well as appear permanently closed and finished when the stitch 97 is added. The polymeric reinforcement member 89 is shown in conjunction with one exploded quadrant of the four dividers 83, 85, 87, and 89 shown in FIG. 3. The adjacent joining stitches 97 are also shown in dashed line format. Both the stitches 100 and 97 are expected to penetrate and secure both the reinforcing material 99 and the reinforcing member 98. At least the lower of the stitch 100 is also expected to penetrate and capture the dividers 83, 85, 87, and 89, and if all other factors permit both of stitches 100 can be used to capture and secure the dividers 83, 85, 87, and 89. The polymeric reinforcement member 98 is an optional structure, and will not, for brevity and clarity, be further shown with respect to the remaining embodiments although it can be utilized.

Figure 5:
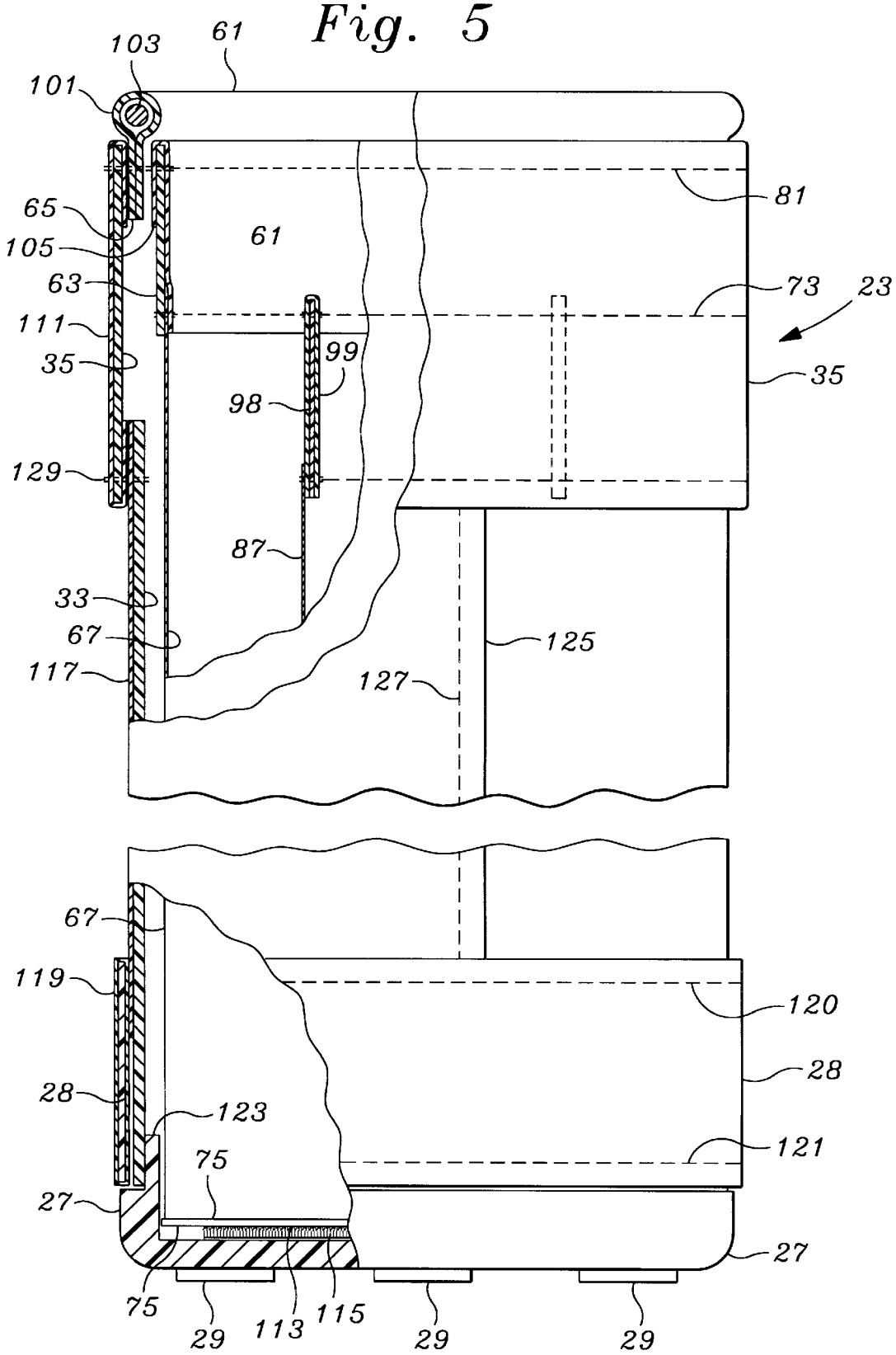
FIG. 5 is a semi sectional and broken center view of the bag of FIG. 1 which illustrates the interrelationship of the bag and the divider and particularly the construction of the upper portion of the bag and the manner of attachment of the inner divider.

Referring to FIG. 5, a partially sectioned plan view of the outer section 23 more clearly illustrates the component parts thereof. The annular collar ring portion 61 is more clearly seen, including a wrapped layer 101, around a metal ring 103, and the downwardly extending length of material 65 is better seen as having a double layer where the inside fold is pressed against the outside fold. The soft surrounding layer 67 is seen as extending up across the inside of the annular stabilization ring 63, over the top and back down terminating in an end edge 105. Given that the size of the ring 103 will leave a slight edge of material visible at the top edge of the annular stabilization ring 63, the fold of the soft surrounding layer 67 gives a better finish and provides for it to be double stitched at stitch 81. Stitch 81 can be accomplished through the soft surrounding layer 67, its enveloped annular stabilization ring 63, the downwardly extending length of material 65, and the service ring 35 at one time, or the Stitch 81 can be accomplished through the soft surrounding layer 67, its enveloped annular stabilization ring 63, and the downwardly extending length of material 65, and the inner section 25 attached into the outer section 23 by gluing or other method.

Also seen is the service ring 35, and as can be seen service ring 35 may be covered by a finished layer 111, and the finished layer may be folded about the top and bottom of the inside of the service ring 35. Below the broken portion of FIG. 5, the soft surrounding layer 67 extends down to the planar expanse of material 75. The bottom of the planar expanse of material 75 has an area 113 of one of hook or loop material, with a matching area 115 of the other of hook and loop material on the bottom inside of the boot 27.

Other details seen in FIG. 5, include a finishing layer 117 which may be applied to the outside of the main body portion 33. Another finishing layer 119 is seen wrapped around the upper and lower edges of the reinforcement ring 28, and secured by stitches 120 and 121 to the main body portion 33. The boot upper portion 123 may be of thick material necessitating gluing or other similar attachment to the main body portion 33, or it may also be sewn if the materials for the boot 27 and the thickness of the upper portion 123 are chosen to facilitate sewing.

The main body portion, having a finished layer 117 or not, is usually closed with a slight overlapping edge 125 and a line of stitching 127. At the top of FIG. 5, the attachment of the reinforcing material 99 to the top of one of the dividers, here shown as divider 87, is seen. Although not immediately discernable from the drawing, but better seen in FIG. 2, the actual terminal side edges 91 occur in a short length of material slightly beyond the line of stitching securing the four dividers 83, 85, 87, & 89 to the stabilization ring 63. The terminal side edges in FIG. 2 may lie to one side of the pair of dividers, for example dividers 87 and 89 as they approach and attach to the stabilization ring 63. Also seen in FIG. 5 is a bottom stitch 129 of the service ring 35 and used to attach service ring 35 to the main body portion 33.

Figure 6:
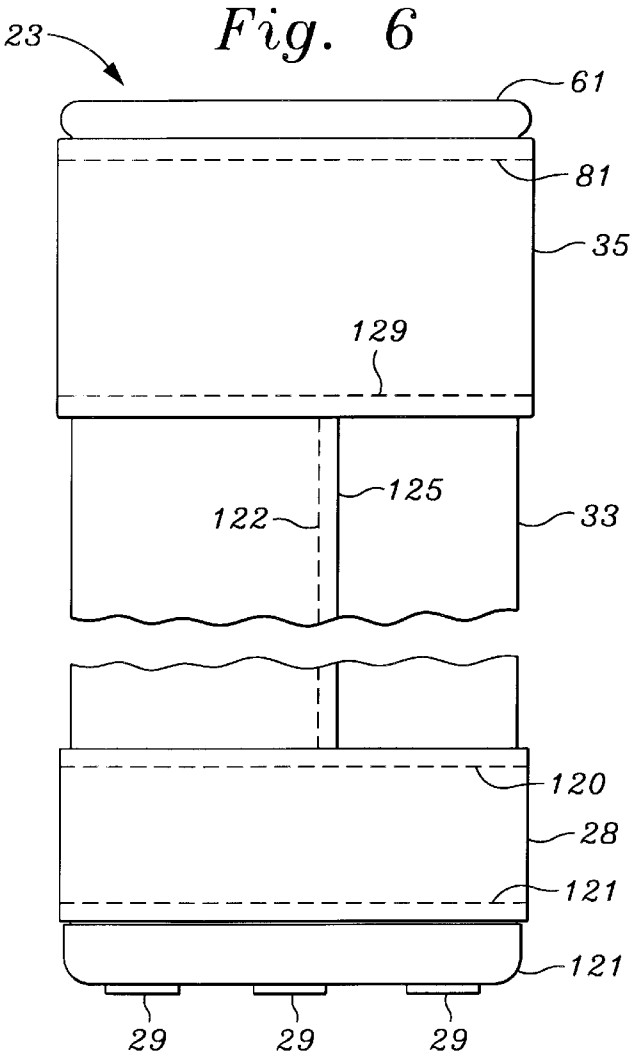
FIG. 6 is a side view of the golf bag seen in FIGS. 1 and 2 in which the outer compartments and pockets have been removed to illustrate the structural supporting components.

Referring to FIG. 6 a plan view of the outer section 23 is seen and ignoring any finishing layers 117, 111, 119 etc. Next to FIG. 6, FIG. 7 illustrates the inner section 25 seen in a slightly upward looking view so that the area of one of the hook and loop members can be seen, as well as the stitching 77 which joins the soft surrounding layer 67 to the planar expanse of material 75.

Figure 7:
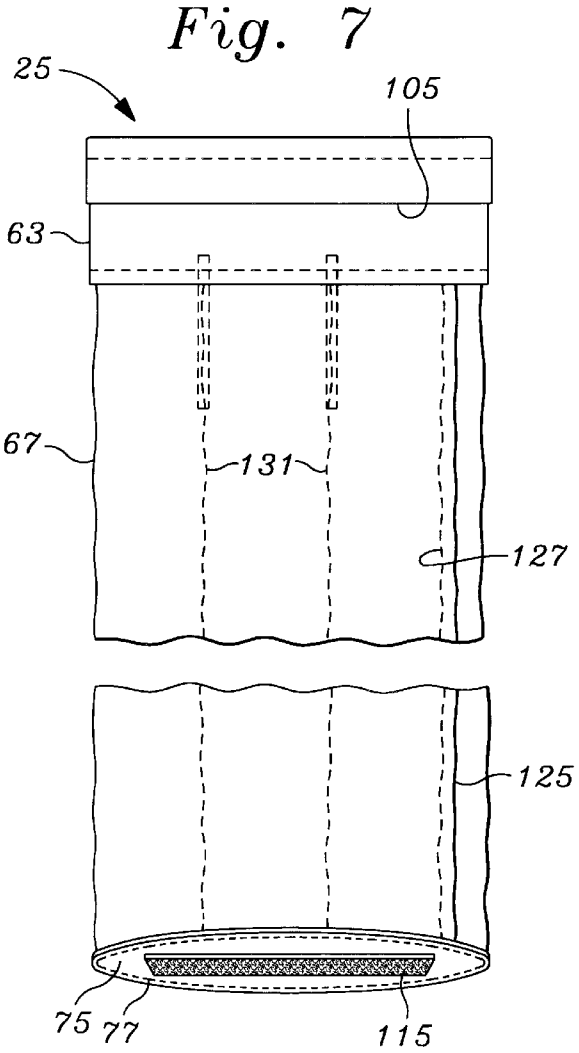
FIG. 7 is a lower side view and illustrating one method of construction using a lower plastic insert and hook and loop attachment structure.

Also seen in FIG. 7 is a long series of stitches 131 which join the four dividers 83, 85, 87, & 89 near their side edges 91, along the full length of the soft surrounding layer 67. As can also be seen, the stitch 127 can be employed for a double purpose of closing the soft surrounding layer 67, and attaching the four dividers 83, 85, 87, & 89 to the soft surrounding layer 67.

Figures 8, 9, 10:
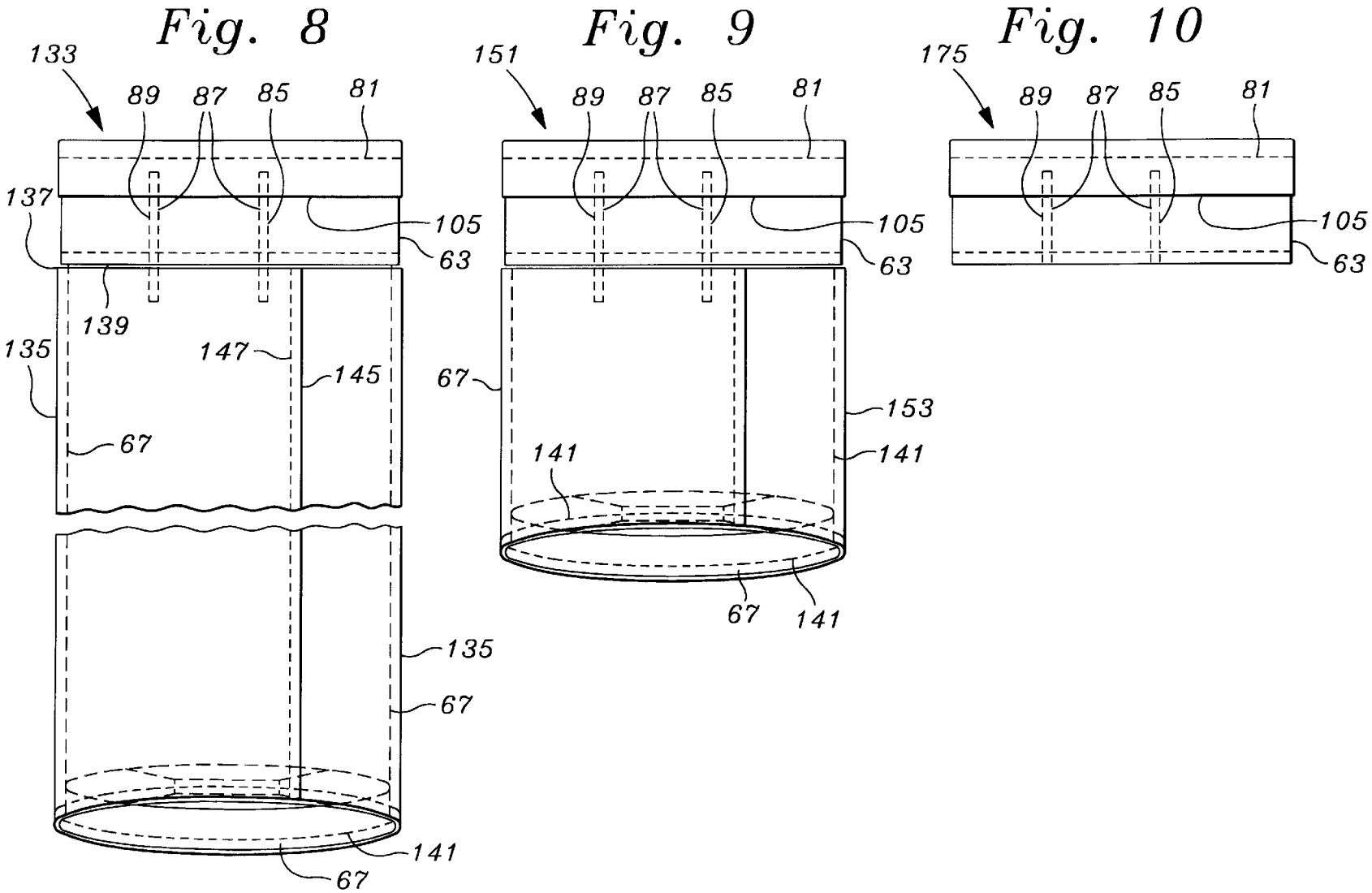
FIG. 8 is another alternative method of construction using a rigid outer layer to abut or optionally be attached to the circular upper divider.
FIG. 9 is a divider similar to that seen in FIG. 8, but having only half the length.
FIG. 10 is a divider similar to that seen in FIG. 9, but having a length extending only to the bottom of the reinforced dividers seen in FIG. 7.

Referring to FIG. 8, a view from a perspective similar to that of FIG. 7 is seen, but of an inner section 133 in which a rigid sleeve 135 surrounds the soft surrounding layer 67. At the upper end of rigid sleeve 135 is an upper edge 137 which abuts a lower edge 139 of the annular stabilization ring 63. Adjacent the lower periphery of the rigid sleeve 135 and the lower periphery of the soft surrounding layer 67, a stitch 141 joins these structures. The downward bearing force from the lower edge 139 of the annular stabilization ring 63 causes the soft surrounding layer 67 to be puled taught and kept open. Since the dividers 83, 85, 87, & 89 are attached to the soft surrounding layer 67 throughout their length, the taughtness and openness of the soft surrounding layer 67 translates into a corresponding taughtness and openness of the dividers 83, 85, 87, & 89. The rigid sleeve 135 is sewn to itself adjacent a generally vertical edge 145, and with a stitch 147, to form the sleeve 135 into a tubular shape.

Referring to FIG. 9, a view from a perspective similar to that of FIG. 8 is seen, but in which an inner section 151 and a rigid sleeve 153 are about half the height of the rigid sleeve 135 as it surrounds the soft surrounding layer 67. Since Junior golf clubs are shorter, under some circumstances, there is less shaft length to be protected, especially if the grips are regular size. In fact, a significant number of sets of junior clubs are made by cutting down regular sized clubs, and adding regular length grips. A half length inner section 151 would still provide significant protection since the portion of the clubs which extend below the bottom of the inner section 151 are mostly protected by the grips on the upper handle. Of course, FIG. 9 need not be an exact half way extension, and the extension can be ¼ or ¾ or anywhere between full length and what is essentially zero length.

The essentially no length case is seen in FIG. 10. FIG. 10 illustrates an inner section 175 having a stabilization ring 63, but with the reinforcements of the dividers 83, 85, 87, & 89 shortened to the bottom of the stabilization ring 63, in order to relieve the necessity of having either a soft surrounding layer or a rigid sleeve 135 or 153. In all of the embodiments of the inner section 133, 151, and 175 the inner section needs to be cemented or otherwise fixed into an outer section 23. Inner sections 151 and 175 especially must be anchored not only to prevent their coming upwardly out of the outer section 23 of the golf bag 21, but also especially anchored to resist downward force where golf clubs would bump or place downward force on the inner sections 151 and 175. Additional sewing, or sewing where the stitch 81 is made through the service ring 35 is preferable.

Figure 11:
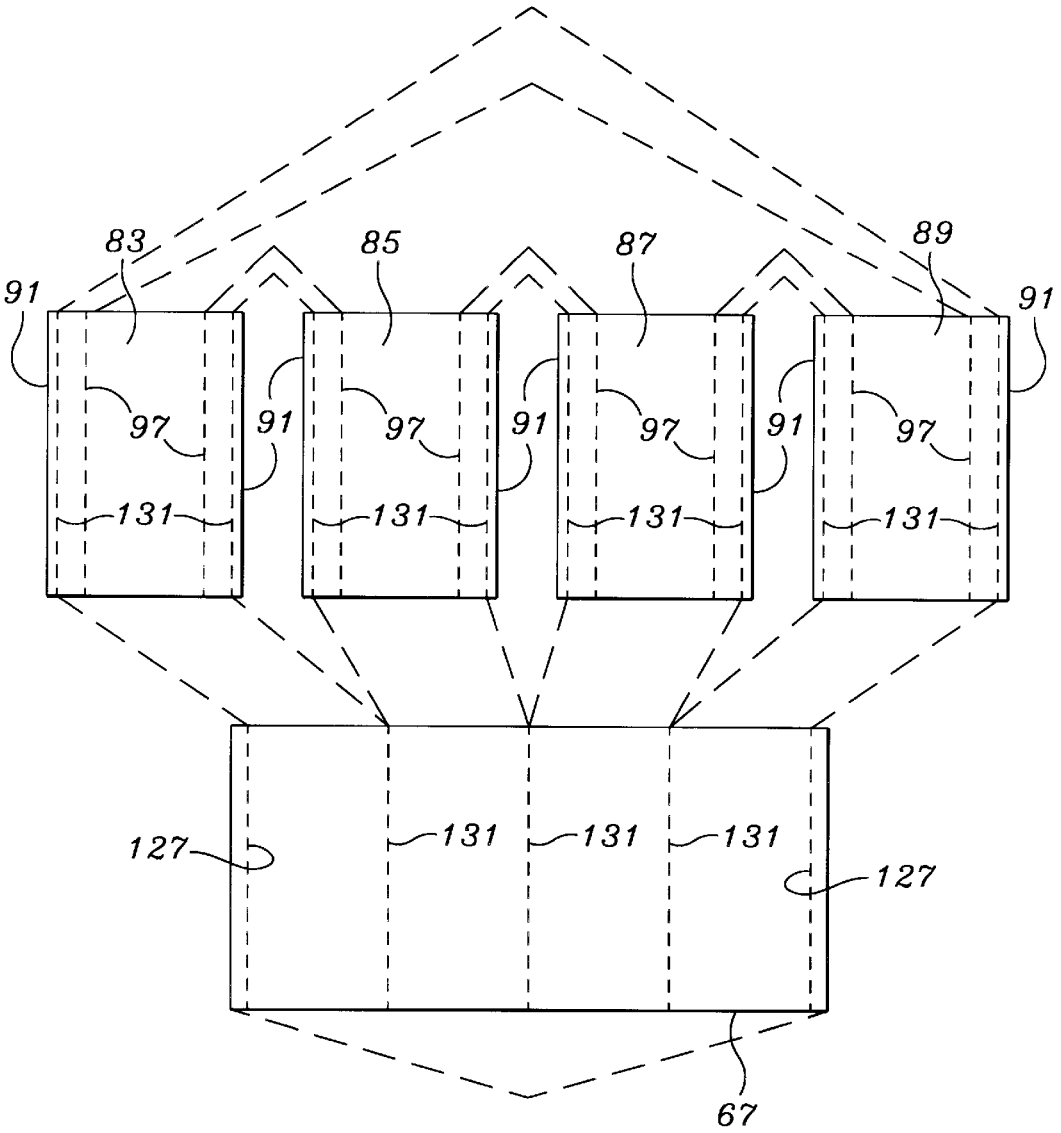
FIG. 11 is an exploded schematic view as an assembly plan of the individual lengths of material which combine to form the soft elongate length of the divider of FIGS. 2 and 4.

Referring to FIG. 11, a construction schematic is shown with the four dividers 83, 85, 87, & 89 in a flat position and illustrating as dashed lines the length of stitched attachment, including stitches 97, 131 and 127. As can be seen, the annular stabilization ring 63 is omitted from the schematic and only four flat expanses of material are needed to make the full length dividers 83, 85, 87, & 89, and that the soft surrounding layer 67 is most efficiently made from a single expanse of material.

Figure 12:
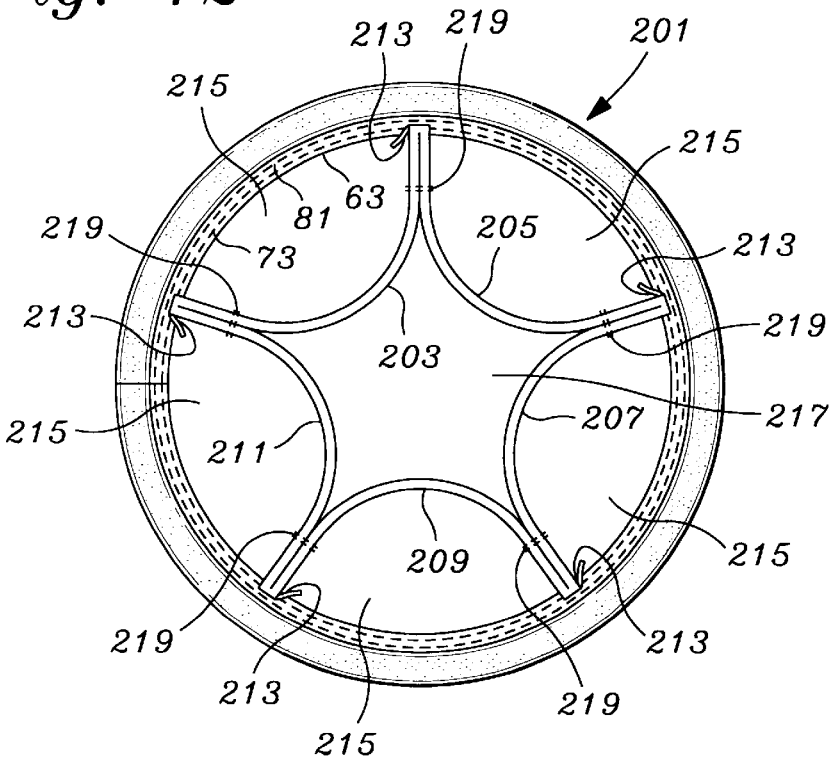
FIG. 12 is a top view of a second embodiment which has five large side pockets which are shaped and joined to provide a stable, five pointed star or pentagon shaped central aperture, to form a five space divider system.

Referring to FIG. 12, a top view of a second embodiment of an inner section 201 having six total spaces, is seen. The smooth covered area of the annular collar ring 61 is seen, as is the first anchoring stitches 81 and 73 which were also seen in FIG. 2. The only structural change seen in FIG. 12 is the addition of an additional divider, and only the changed structures are renumbered.

Again, in FIG. 12, to eliminate confusion, the portion of the inner section 201 below the annular stabilization ring 63 is not shown. The most prominent structures within the annular collar ring portion 61 include a series of five dividers 203, 205, 207, 209 & 211. Again, the dividers 203, 205, 207, 209 & 211 may be supplied as a continuous length of material, subcomponents of other lengths of material, or each divider made up of subcomponents of material joined together as was set forth for dividers 83, 85, 87, & 89. Each of the five dividers 203, 205, 207, 209 & 211 have a first end or side edge and a second side end or side edge, both labeled 213 (and seen in FIG. 14). Each of the five dividers 203, 205, 207, 209 & 211 have a length of attachment near their side edges 213 attached to and extend from the annular stabilization ring 63 in a direction toward the center of the inner section 25, but begin curving immediately. The curvature continues through an angle of greater than 90° and terminating at their second side edge 213, with attachment immediately adjacent the side edge 213 and to the annular stabilization ring 63. Each of the five dividers 203, 205, 207, 209 & 211 forms a storage pocket or side pocket 215. Each of the side pockets 215 define or form a central storage pocket or central pocket 217 which is in the shape of a five pointed star or curved sided pentagon shape.

The shape of the central pocket 95 is assisted by stitches 219 between adjacent ones of the five dividers 203, 205, 207, 209 & 211 to prevent the shape of the dividers from being compressed due to any clubs creating force at the apex of the legs of the five pointed star shaped or pentagon shaped central pocket 217. The distance of the stitch 219 from the annular stabilization ring 63 helps define the overall shape of the central pocket 217. Stitches 219 farther from the annular stabilization ring 63 makes each of the five dividers 203, 205, 207, 209 & 211 assume a more angular shape, and makes the central pocket 217 smaller and less curving. The resulting fanciful pattern is symmetrical.

Figure 13:
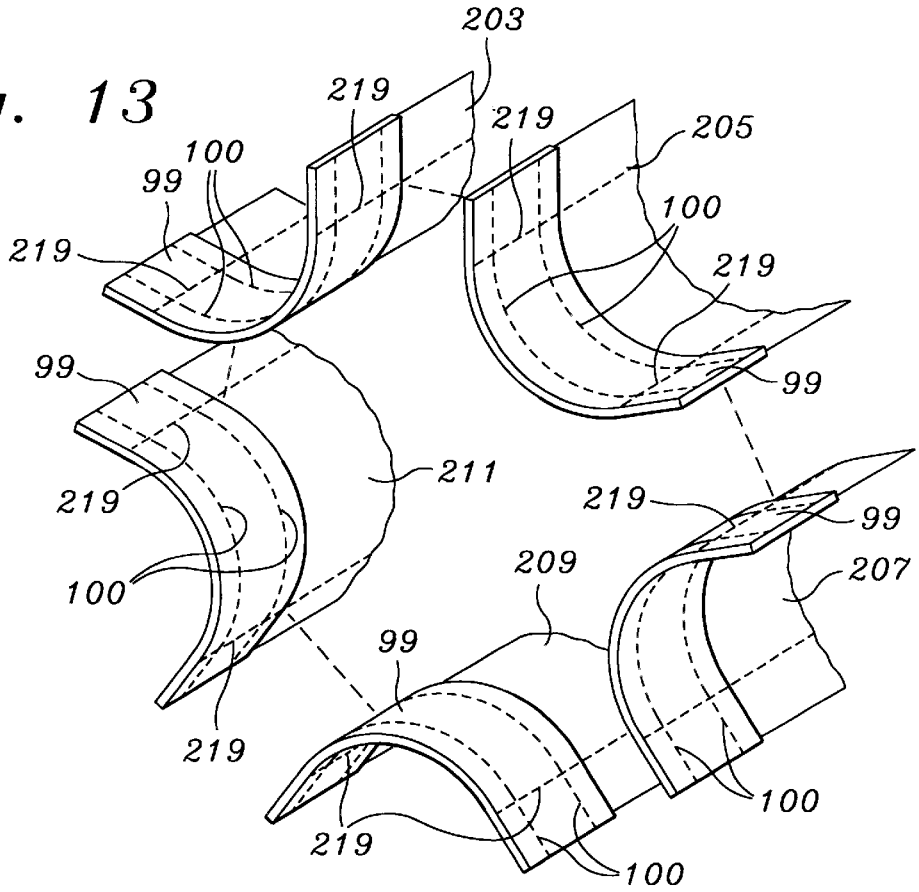
FIG. 13 is a perspective end view of the segments which are joined together to form the divider system shown in FIG. 12.

Referring to FIG. 13, an exploded perspective view of the ends of the five dividers 203, 205, 207, 209 & 211 is shown. Ideally, the lengths of reinforcing material 99 will be sewn separately to its associated divider 203, 205, 207, 209 & 211. Also shown are the adjacent adjoinment stitches 219.

Figure 14:
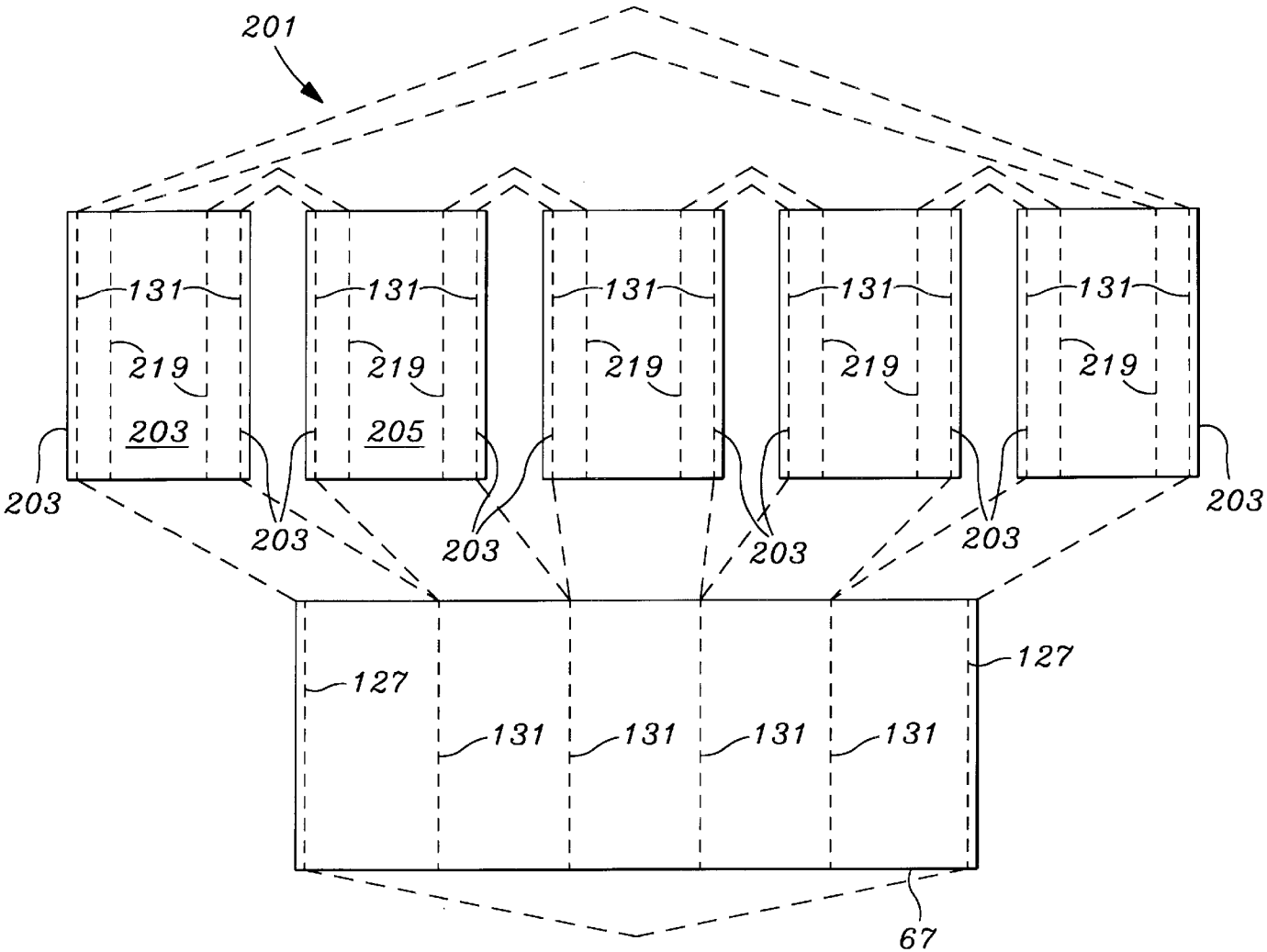
FIG. 14 is an exploded schematic view as an assembly plan of the individual lengths of material which combine to form the soft elongate length of the divider of FIGS. 12 and 13.

Referring to FIG. 14, a partially sectioned plan view of the softer portions of the inner section 201 more clearly and schematically illustrates the component parts thereof The dividers 203, 205, 207, 209 & 211 are shown in relationship to the soft surrounding layer 67 and in flat format.

Referring to FIG. 14, a construction schematic is shown with the five dividers 203, 205, 207, 209 & 211 in a flat position and illustrating as dashed lines the length of stitched attachment, including stitches 219, 131 and 127. As can be seen, the annular stabilization ring 63 is omitted from the schematic and only five flat expanses of material are needed to make the fill length dividers 203, 205, 207, 209 & 211, and that the soft surrounding layer 67 is most efficiently made from a single expanse of material.

Figure 15:
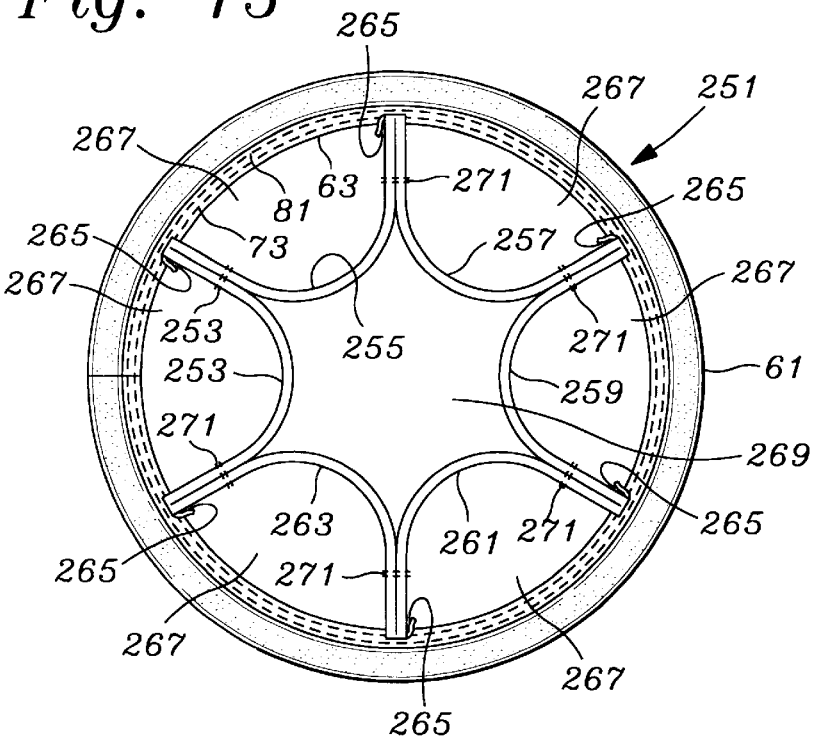
FIG. 15 is a top view of a third embodiment which has six large side pockets which are shaped and joined to provide a stable, symmetrical, six pointed star or curved hexagonally shaped central aperture, to form a seven space divider system.

Referring to FIG. 15, a top view of a third embodiment of an inner section 251 having seven total spaces, is seen. The smooth covered area of the annular collar ring 61 is seen, as are the first anchoring stitches 81 and 73 which were also seen in FIG. 2. The only structural change seen in FIG. 15 is the addition of an additional divider, and only the changed structures are renumbered.

Again, in FIG. 15, to eliminate confusion, the portion of the inner section 251 below the annular stabilization ring 63 is not shown. The most prominent structures within the annular collar ring portion 61 include a series of six dividers 253, 255, 257, 259, 261 & 263. Again, the dividers 253, 255, 257, 259, 261 & 263 may be supplied as a continuous length of material, subcomponents of other lengths of material, or each divider made up of subcomponents of material joined together as was set forth for dividers 83, 85, 87, & 89, and 203, 205, 207, 209 & 211. Each of the six dividers 253, 255, 257, 259, 261 & 263 have a first end or side edge and a second side end or side edge, both labeled 265 (best seen in FIG. 17). Each of the six dividers 253, 255, 257, 259, 261 & 263 have a length of attachment near their side edges 265 attached to and extend from the annular stabilization ring 63 in a direction toward the center of the outer section 251, but begin curving immediately. The curvature continues through an angle of much greater than 90° and terminating at their second side edge 265, with attachment immediately adjacent the side edge 265 and to the annular stabilization ring 63. Each of the six dividers 253, 255, 257, 259, 261 & 263 forms a storage pocket or side pocket 267. Each of the side pockets 267 define or form a central storage pocket or central pocket 269 which is in the shape of a six pointed star or curved sided hexagon shape.

The shape of the central pocket 269 is assisted by stitches 271 between adjacent ones of the six dividers 253, 255, 257, 259, 261 & 263 to prevent the shape of the dividers from being compressed due to any clubs creating force at the apex of the legs of the six pointed star shaped or hexagon shaped central pocket 269. The distance of the stitch 271 from the annular stabilization ring 63 helps define the overall shape of the central pocket 269. The resulting fanciful pattern is symmetrical, regardless of how far the stitches 271 are from the annular stabilization ring 63.

Figure 16:
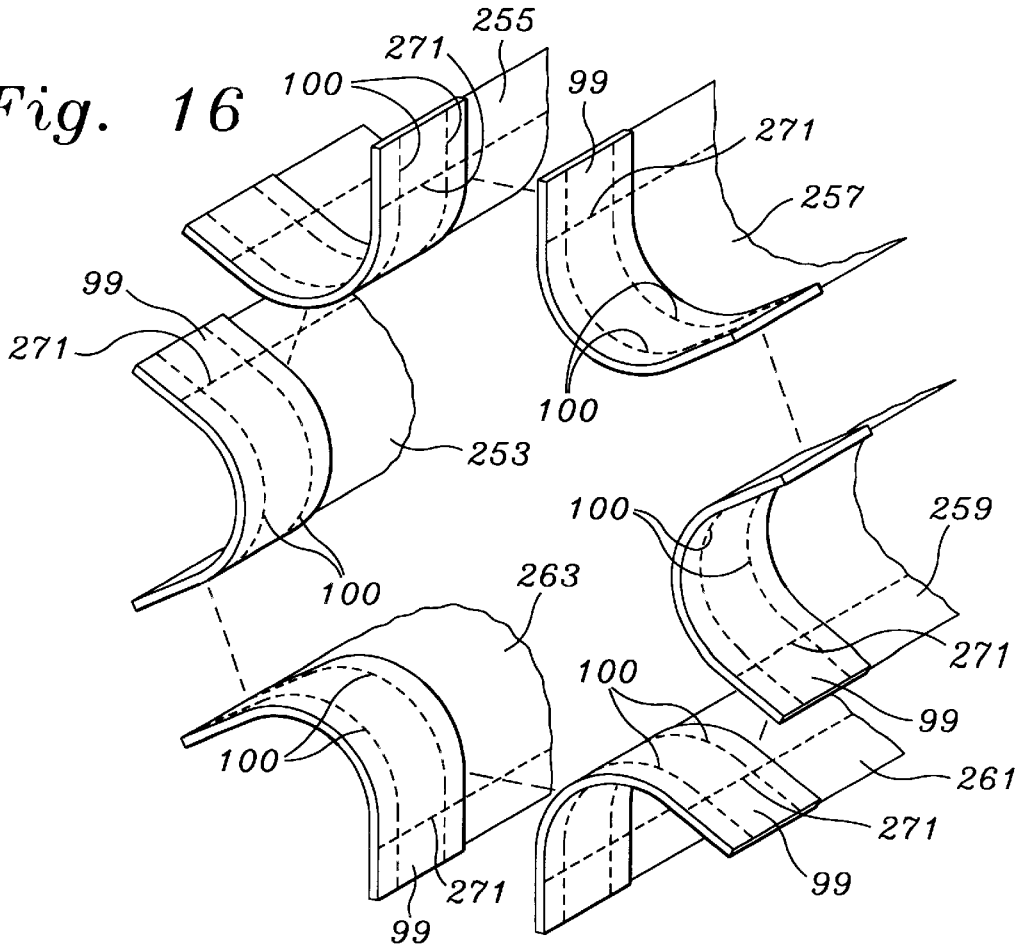
FIG. 16 is a perspective end view of the segments which are joined together to form the divider system shown in FIG. 15.

Referring to FIG. 16, an exploded perspective view predominantly centered on the portions of the ends of the dividers apart from the annular stabilization ring 63 is shown. makes each of the six dividers 253, 255, 257, 259, 261 & 263 assume a more angular shape, and makes the central pocket 217 smaller and less curving is shown. The stitches 271 are shown in dashed line format where visible in FIG. 16.

Figure 17:
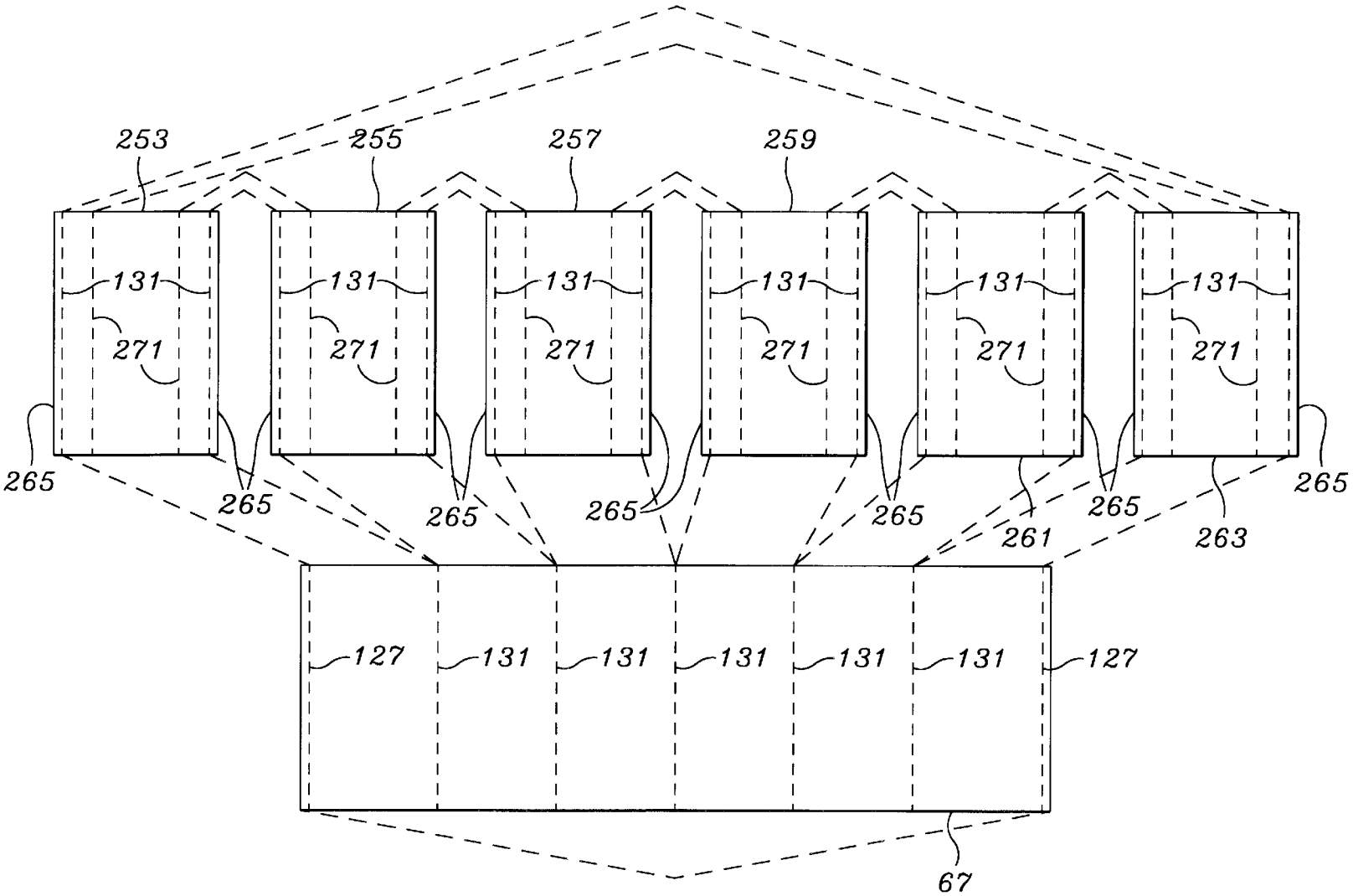
FIG. 17 is an exploded schematic view as an assembly plan of the individual lengths of material which combine to form the soft elongate length of the divider of FIGS. 15 and 16.

Referring to FIG. 17, a partially sectioned plan view of the softer portions of the inner section 251 more clearly and schematically illustrates the component parts thereof. The six dividers 253, 255, 257, 259, 261 & 263 are shown in relationship to the soft surrounding layer 67 and in flat format.

Figure 18:
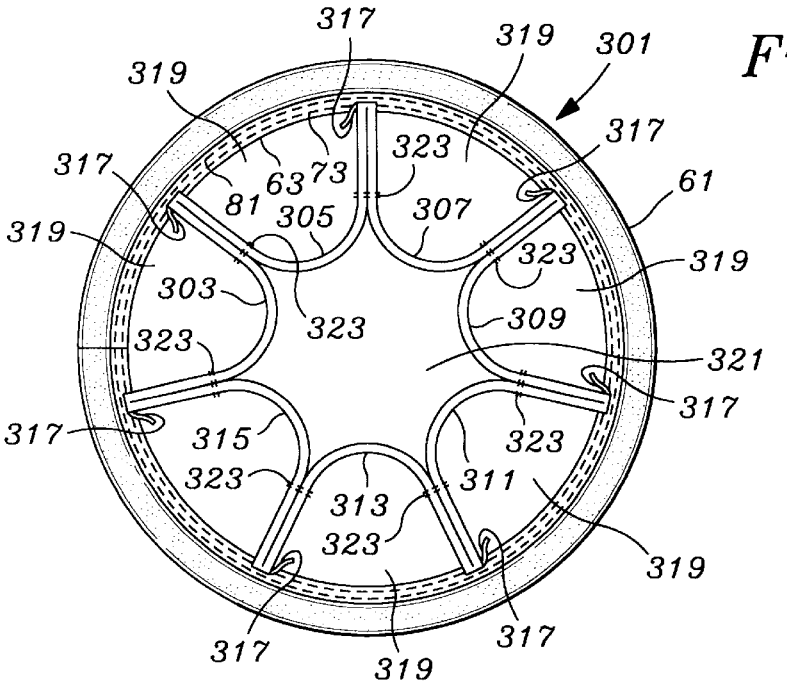
FIG. 18 is a top view of a fourth embodiment which uses seven large side pockets which are shaped and joined to provide a stable, seven pointed star or heptagon shaped central aperture, to form an eight space divider system.

Referring to FIG. 18, a top view of a fourth embodiment of an inner section 301 having eight total spaces, is seen. The smooth covered area of the annular collar ring 61 is seen, as are the first anchoring stitches 81 and 73 which were also seen in FIGS. 2, 12 & 15. The only structural change seen in FIG. 18, with respect to FIG. 15 is the addition of an additional divider, and only the changed structures are renumbered.

Again, in FIG. 18, to eliminate confusion, the portion of the inner section 301 below the annular stabilization ring 63 is not shown. The most prominent structures within the annular collar ring portion 61 include a series of seven dividers 303, 305, 307, 309, 311, 313 & 315. Again,the dividers 303, 305, 307, 309, 311, 313 & 315 maybe supplied as a continuous length of material, subcomponents of other lengths of material, or each divider made up of subcomponents of material joined together as was set forth for dividers 83, 85, 87, & 89; 203, 205, 207, 209 & 211, and 253, 255, 257, 259, 261 & 263. Each of the seven dividers 303, 305, 307, 309, 311, 313 & 315 have a first end or side edge and a second side end or side edge, both labeled 317(also seen in FIG. 20). Each of the seven dividers 303, 305, 307, 309, 311, 313 & 315 have a length of attachment near their side edges 317 attached to and extend from the annular stabilization ring 63 in a direction toward the center of the outer section 301, but begin curving immediately. The curvature continues more sharply still through an angle of much greater than 90° and terminating at their second side edge 317, with attachment immediately adjacent the side edge 317 and to the annular stabilization ring 63. Each of the seven dividers 303, 305, 307, 309, 311, 313 & 315 forms a storage pocket or side pocket 319. Each of the side pockets 319 define or form a central storage pocket or central pocket 321 which is in the shape of a seven pointed star or curved sided heptagon shape.

The shape of the central pocket 321 is assisted by stitches 323 between adjacent ones of the seven dividers 303, 305,

307, 309, 311, 313 & 315 to prevent the shape of the dividers from being compressed due to any clubs creating force at the apex of the legs of the seven pointed star shaped or heptagon shaped central pocket 321. The distance of the stitch 323 from the annular stabilization ring 63 helps define the overall shape of the central pocket 321. The resulting fanciful pattern is symmetrical, regardless of how far the stitches 323 are from the annular stabilization ring 63.

Figure 19:
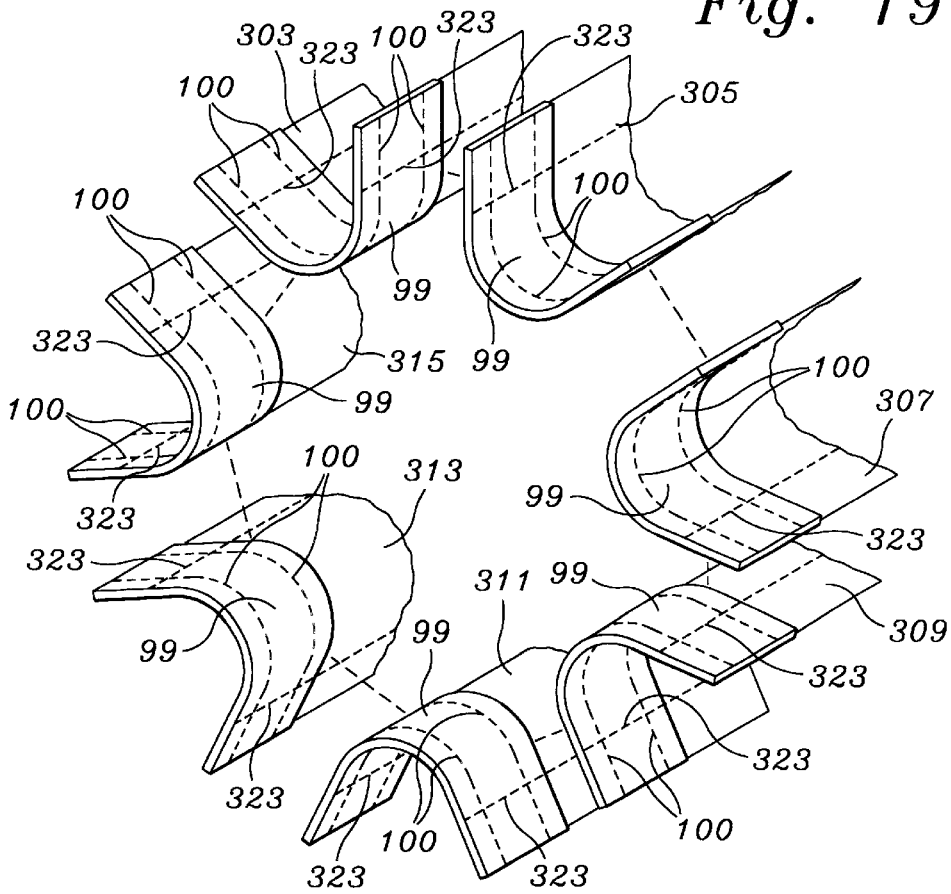
FIG. 19 is a perspective end view of the segments which are joined together to form the divider system shown in FIG. 15.

Referring to FIG. 19, an exploded perspective view predominantly centered on the ends of the dividers 303, 305, 307, 309, 311, 313 & 315 and lengths of reinforcing material 99 apart from the annular stabilization ring 63 is shown. The stitches 323 are shown in dashed line format where visible in FIG. 19.

Figure 20:
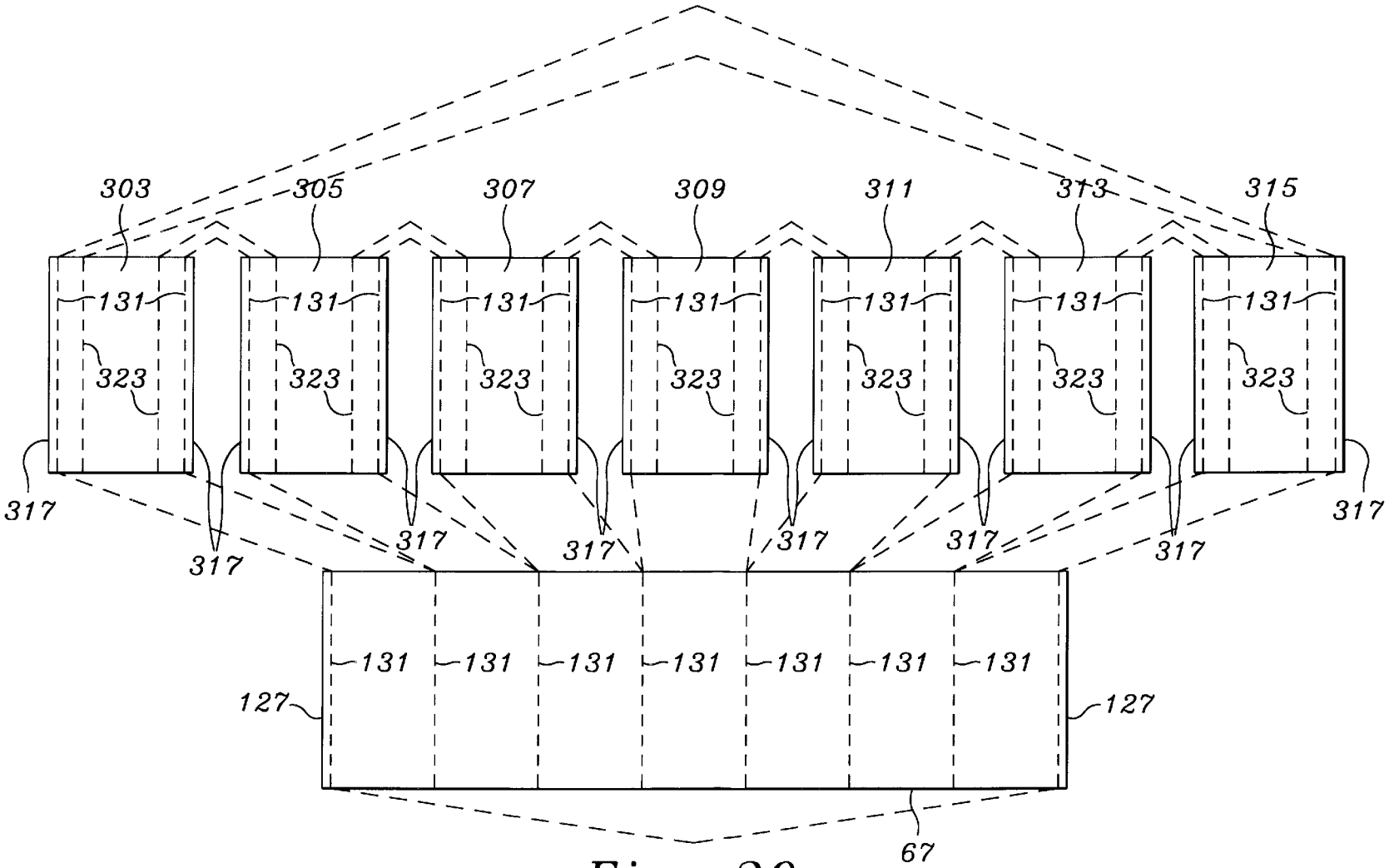
FIG. 20 is an exploded schematic view as an assembly plan of the individual lengths of material which combine to form the soft elongate length of the divider of FIGS. 18 and 19.

Referring to FIG. 20, a partially sectioned plan view of the softer portions of the inner section 301 more clearly and schematically illustrates the component parts thereof. The seven dividers 303, 305, 307, 309, 311, 313 & 315 are shown in relationship to the soft surrounding layer 67 and in flat format.

Figure 21:
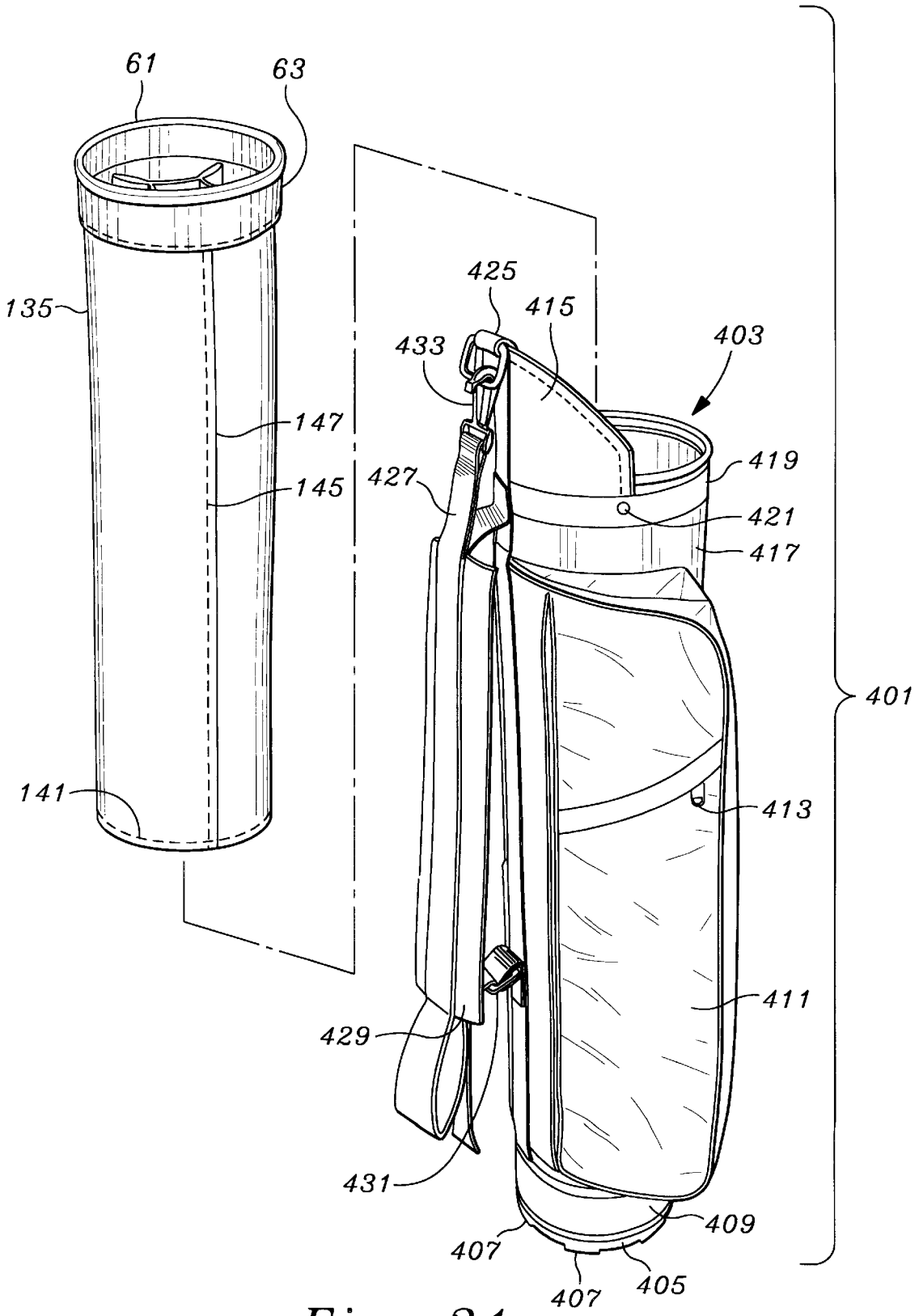
FIG. 21 is a perspective exploded view of a second embodiment of the outer section of the golf bag of the present invention and illustrated with the inner section having a rigid outer section removed from and seen to the side of the main golf bag outer section.

Referring to FIG. 21, a golf bag 401 is shown as having an inner section or divider assembly 133, as was shown in FIG. 8. The inner section 133 fits within an outer section 403. Outer section 403 has a lower boot 405 with leg portions 407 and a lower reinforcement ring 409. A side compartment or tangentially emerging storage pouch 411 may have a zipper 413. At the top of outer section 403, an upwardly extending guard 415 provides a higher vantage point from which a strap can depend. The guard 415 is attached to a main body portion 417 at a reinforcement ring 419 which may have a reinforcing rivet 421. A "D" ring 423 is attached to a holding strap 425 at the top of the guard 415. "D" ring 423 has an attached shoulder strap 427 which may have a padded portion 429. Strap 427, at its lower extent may have a snap fitting 431 which attached to the main body 417 of the outer section 417 of the golf bag 401. A metal hook fitting 433 is used to attach the shoulder strap 427 to the "D" ring 423.

Figure 22:
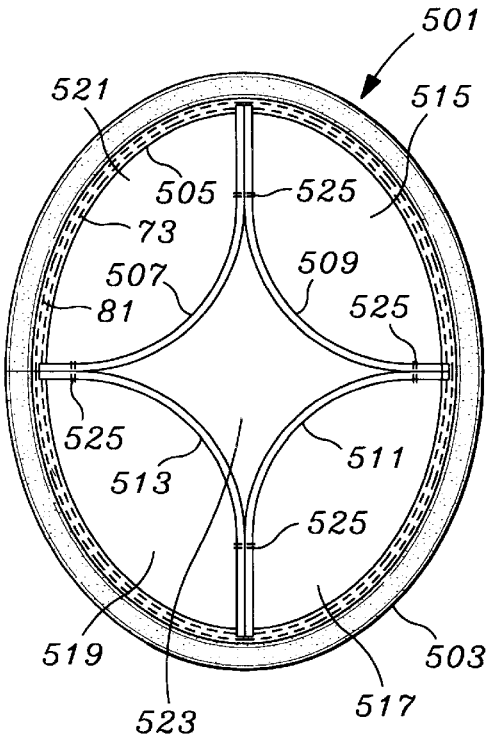
FIG. 22 is a top view of a variation on the shape of the golf bag divider of the present invention and illustrating an oval shaped inner divider section.

Referring to FIG. 22, a downward view of a variation of the inner section 25 of FIG. 2 is seen as an oval shaped inner section 501. An annular collar ring portion 503 is oval shaped, but the stitches 73, 81 are now sewn with respect to an annular stabilization ring 505 which is also oval shaped. In many instances, the annular stabilization ring 505 may have its shape dictated by the more rigid annular collar ring portion 503, to ease construction and eliminate the need to make a specially constructed annular stabilization ring 505.

Oval shaped inner section 501 has a series of four dividers 507, 509, 511, and 513 which may be the same widths as the dividers 83, 85, 87, & 89, but since two opposite sides move toward each other while two opposite sides move away from each other, no change in lengths of the dividers 83, 85, 87, & 89 is necessary. In FIG. 22, a series of pockets 515, 517, 519 and 521 surround and create a central pocket 523. Note that the star shape of the central pocket 523 is not such that one axis is longer than the other. Here, the stitches 525 which join adjacent ones of the pockets 515, 517, 519 and 521 are set such that the star shape of the central pocket 523 is equilateral. One pair of stitches 525 are farther away from the annular stabilization ring than the other to compensate for the oval shape of the inner section.

Figure 23:
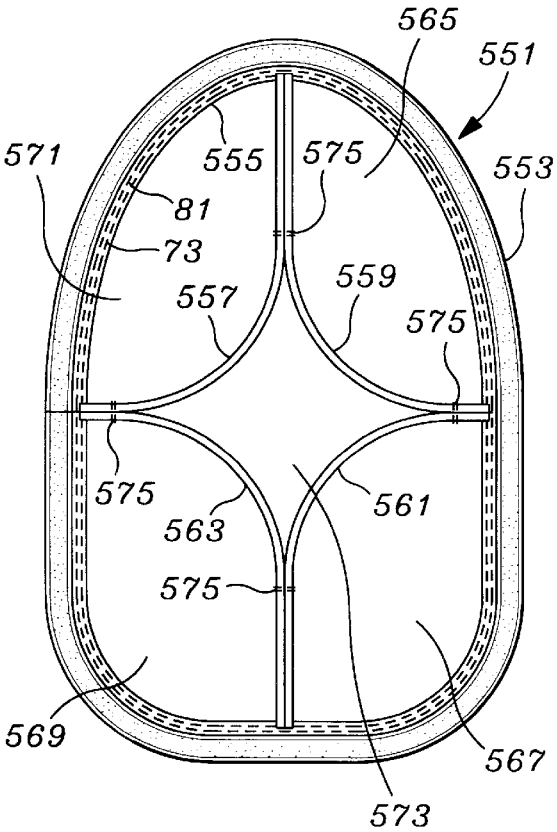
FIG. 23 is a top view of a variation on the shape of the golf bag divider of the present invention and illustrating a "ham shaped" inner divider section.

Referring to FIG. 23, a downward view of another variation of the inner section 25 of FIG. 2 is seen as a semi-elliptical shaped inner section 551, the shape also being known as a "ham shape". An annular collar ring portion 553 is oval shaped, but the stitches 73, 81 are now sewn with respect to a ham shaped annular stabilization ring 555 which is also ham shaped. In many instances, the ham shaped annular stabilization ring 555 may have its shape dictated by the more rigid annular collar ring portion 553, to ease construction and eliminate the need to make a specially constructed annular stabilization ring 555.

Ham shaped inner section 551 has a series of four dividers 557, 559, 561, and 563 which may be the same widths as the dividers 83, 85, 87, & 89, but the center of the resulting space may be displaced due to the ham shape. In FIG. 23 a series of pockets 565, 567, 569 and 571 surround and create a central pocket 573. One pair of stitches 575 are farther away from the annular stabilization ring than the other to compensate for the oval shape of the oval shape of the inner section.

Figure 24:
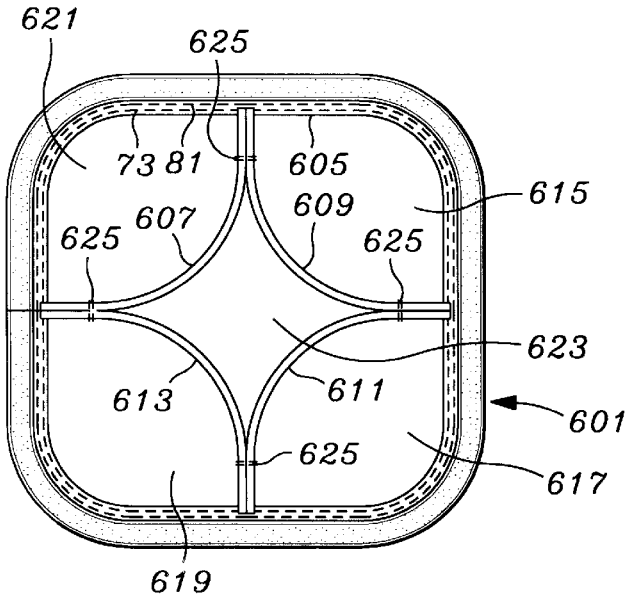
FIG. 24 is a top view of a variation on the shape of the golf bag divider inner section of the present invention and illustrating a rectangular shape but having rounded corners.

Referring to FIG. 24, a downward view of another variation of the inner section 25 of FIG. 2 is seen as a rectangular shaped inner section 601. An annular collar ring portion 603 is oval shaped, but the stitches 73, 81 are now sewn with respect to a rectangular shaped annular stabilization ring 605. In many instances, the annular stabilization ring 605 may have its shape dictated by the more rigid rectangular annular collar ring portion 603, especially since the corners of the rectangular shape are well rounded.

Oval shaped inner section 601 has a series of four dividers 607, 609, 611, and 613 which may be the same widths as the dividers 83, 85, 87, & 89, since the distances from the center of inner section 601 to the attachment sides are the same. A series of pockets 615, 617, 619 and 621 surround and create a central pocket 623. Here, stitches 625 which join adjacent ones of the pockets 615, 617, 619 and 621 are set such that the star shape of the central pocket 625 is equilateral, but it need not be.

While the present invention has been described in terms of a junior sized golf bag, and in terms of several embodiments of an interior portions to be inserted into an outer section of a golf bag, as well as the method of construction of the inner sections, one skilled in the art will realize that the structure and techniques of the present invention can be applied to many appliances. The present invention may be applied in any situation where compartments are to be created which not only have an aesthetically pleasing fanciful pattern, but which provide a center storage compartment without having to provide any additional structure beyond a series of side pockets one or more of which may be joined to adjacent ones of the side pockets to define a center structure.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A golf bag inner section comprising:

an expanse of pliable covering material formed into a tube and having a length extending from a top end to a bottom end;

a plurality of dividers each having a first side edge and a second side edge, each first side edge of each one of said plurality of dividers attached to said covering material immediately adjacent said second side edge of another one of each one of said plurality of dividers, said first and second side edges extending substantially along said length of said expanse of pliable material;

a holding structure, attached to said bottom end of said expanse of pliable covering material, for holding said plurality of dividers in a stable orientation; and an annular collar ring attached to said pliable covering material.

2. The golf bag inner section as recited in claim 1 wherein each of said plurality of dividers have a top edge and a bottom edge and further comprising:

at least one layer of reinforcing material having a folded shape and covering the top edges of said plurality of dividers; and a reinforcement member associated with each one of said plurality of dividers and attached to said reinforcing layer.

3. The golf bag inner section as recited in claim 2 wherein said reinforcement members are attached within said folded reinforcing layer.

4. The golf bag inner section as recited in claim 3 wherein each of said plurality of dividers is attached to one side of its associated said reinforcement member.

5. The golf bag inner section as recited in claim 3 wherein each of said plurality of dividers is attached within its associated said folded reinforcement layer.

6. The golf bag inner section as recited in claim 2 and wherein said plurality of dividers are each connected to an adjacent one of said plurality of dividers at least one point spaced apart from each of said plurality of dividers' attachment to said covering material to control the size and shape of a central pocket, and wherein at least one layer of reinforcing material associated with each one of said plurality of dividers is each connected to an adjacent layer of reinforcing material associated with another one of said plurality of dividers to control the size and shape of a central pocket adjacent said top edge of said plurality of dividers.

7. The golf bag inner section as recited in claim 6 and wherein said connection of said at least one layer of reinforcing material associated with each one of said plurality of dividers to an adjacent layer of reinforcing material associated with another one of said plurality of dividers also connects said reinforcement members associated with each one of said plurality of dividers.

8. The golf bag inner section as recited in claim 1 and further comprising:

a stabilization metal ring;

a stabilization ring outer wrapped layer having a first side surrounding an inside side of said stabilization metal ring and extending axially away from said stabilization metal ring in a first direction, and having a second side surrounding an outside side of said stabilization metal ring and extending axially away from said stabilization metal ring along side said first side of said wrapped layer, and wherein said first and second sides which extend axially away from said stabilization metal ring are attached to said annular collar ring.

9. The golf bag inner section as recited in claim 8 and wherein said annular collar ring and said stabilization metal ring are oval shaped.

10. The golf bag inner section as recited in claim 8, and wherein said annular collar ring and said stabilization metal ring are ham shaped.

11. The golf bag inner section as recited in claim 8, and wherein said annular collar ring and said stabilization metal ring are generally rectangular shaped with rounded corners.

12. The golf bag inner section as recited in claim 1 and further comprising a planar expanse of material of a shape generally congruent to a transverse shape of said tube of said expanse of pliable covering material, and attached to and covering said bottom end.

13. The golf bag inner section as recited in claim 12 and further comprising a golf bag outer section having an upper opening into a cylindrical space bound by a bottom surface at the terminal end of said cylindrical space and into which said golf bag inner section is insertably fixed, said planar expanse of material fixed with respect to said bottom surface.

14. The golf bag inner section as recited in claim 13 and further comprising:

a first patch of hook and loop material having one of a plurality of loop and hook members and attached to an outer surface of said planar expanse of material; and a second patch of hook and loop material having the other one of a plurality of loop and hook members attached to said bottom surface of said outer section and oriented to mate with said first patch of hook and loop material to hold said inner section with respect to said outer section.

15. The golf bag inner section as recited in claim 1 and further comprising:

a rigid sleeve of material also formed into a tube shape and having a first end attached adjacent said bottom end of said expanse of pliable covering material and a second end attached near said top end of said expanse of pliable covering material to hold said expanse of pliable covering material in a stable tubular configuration.

16. The golf bag inner section as recited in claim 15 wherein said first end of said rigid sleeve of material is attached to said bottom end of said expanse of pliable covering material by a stitch adjacent the ends of said first end of said rigid sleeve of material and said bottom end of said expanse of pliable covering material.

17. The golf bag inner section as recited in claim 16 and further comprising a golf bag outer section having an upper opening into a cylindrical space and into which said golf bag inner section is insertably fixed.

18. The golf bag inner section as recited in claim 17 and further comprising:

a golf bag outer section having an upper opening; and an upwardly extending guard lying adjacent said annular collar ring attached to said pliable covering material.

19. The golf bag inner section as recited in claim 18 and further comprising a strap attachment member atop said upwardly extending guard to raise the point of attachment of a strap above said annular collar ring.

20. The golf bag inner section as recited in claim 1 and wherein said plurality of dividers are each connected to an adjacent one of said plurality of dividers at least one point spaced apart from each of said plurality of dividers' attachment to said covering material to control the size and shape of a central pocket.

21. The golf bag inner section as recited in claim 1 and wherein said plurality of dividers each have an inside surface facing said covering material and an outside surface, said outside surface of said plurality of dividers forming a central pocket.

22. A golf bag comprising:

a shallow, cup-shaped boot;

a rigid main body portion having a first end and having a second end supported by and surrounding an upper portion of said boot;

a reinforcement ring adjacent said second end of said rigid main body portion and supported by and surrounding said upper portion of said boot;

a service ring having a first end and a second end attached to said rigid main body portion adjacent said first end of said main body portion; and a golf bag inner section within said service ring and fixed to said service ring.

23. The golf bag as recited in claim 22 and further comprising:

a stabilization metal ring;

a stabilization ring outer wrapped layer having a first side surrounding an inside side of said stabilization metal ring and extending axially away from said stabilization metal ring in a first direction, and having a second side surrounding an outside side of said stabilization metal ring and extending axially away from said stabilization metal ring along side said first side of said wrapped layer, and wherein said first and second sides which extend axially away from said stabilization metal ring are attached to said service ring adjacent said first end of said service ring.

24. The golf bag as recited in claim 22 and wherein said inner section further comprises:

an expanse of pliable covering material formed into a tube and having a length extending from a top end to a bottom end;

a plurality of dividers each having a first side edge and a second side edge, each first side edge of each one of said plurality of dividers attached to said covering material immediately adjacent said second side edge of another one of each one of said plurality of dividers, said first and second side edges extending substantially along said length of said expanse of pliable material;

a holding structure, attached to said bottom end of said expanse of pliable covering material, for holding said plurality of dividers in a stable orientation; and an annular collar ring attached to said pliable covering material.

25. The golf bag as recited in claim 24 wherein each of said plurality of dividers have a top edge and a bottom edge and further comprising:

at least one layer of reinforcing material having a folded shape and covering the top edges of said plurality of dividers; and a reinforcement member associated with each one of said plurality of dividers and attached to said reinforcing layer.

26. The golf bag as recited in claim 25 and wherein said plurality of dividers are each connected to an adjacent one of said plurality of dividers at least one point spaced apart from each of said plurality of dividers' attachment to said covering material to control the size and shape of a central pocket, and wherein at least one layer of reinforcing material associated with each one of said plurality of dividers is each connected to an adjacent layer of reinforcing material associated with another one of said plurality of dividers to control the size and shape of a central pocket adjacent said top of said plurality of dividers.

27. The golf bag as recited in claim 25 wherein said reinforcement members are attached within said reinforcing layer.

28. The golf bag as recited in claim 27 wherein each of said plurality of dividers is attached to one side of its associated said reinforcement member.

29. The golf bag as recited in claim 28 and further comprising:

a first patch of hook and loop material having one of a plurality of loop and hook members and attached to an outer surface of said planar expanse of material; and a second patch of hook and loop material having the other one of a plurality of loop and hook members attached to an inside surface of said boot and oriented to mate with said first patch of hook and loop material to hold said inner section with respect to said boot.

30. The golf bag as recited in claim 24 and further comprising:

a rigid sleeve of material also formed into a tube shape and having a first end attached adjacent said bottom end of said expanse of pliable covering material and a second end attached near said top end of said expanse of pliable covering material to hold said expanse of pliable covering material in a stable tubular configuration.

31. The golf bag as recited in claim 30 wherein said first end of said rigid sleeve of material is attached to said bottom end of said expanse of pliable covering material by a stitch adjacent the ends of said first end of said rigid sleeve of material and said bottom end of said expanse of pliable covering material.

32. The golf bag as recited in claim 24 and wherein said plurality of dividers are each connected to an adjacent one of said plurality of dividers at least one point spaced apart from each of said plurality of dividers' attachment to said covering material to control the size and shape of a central pocket.

33. The golf bag as recited in claim 24 and wherein said plurality of dividers each have an inside surface facing said covering material and an outside surface, said outside surface of said plurality of dividers forming a central pocket.

34. The golf bag as recited in claim 33 and wherein said central pocket has a star shape.

35. The golf bag as recited in claim 22 and further comprising a planar expanse of material of a shape generally congruent to a transverse shape of said inner section, and attached to and covering a bottom end of said inner section.

36. The golf bag as recited in claim 22 and further comprising an upwardly extending curved guard lying adjacent and attached to said service ring.

37. The golf bag as recited in claim 36 and further comprising a strap attachment member atop said upwardly extending guard to raise the point of attachment of a strap above said annular collar ring.

38. The golf bag as recited in claim 22 and wherein said inner section has, as seen from a transverse view, an oval shape.

39. The golf bag as recited in claim 22 and wherein said inner section has, as seen from a transverse view, a ham shape.

40. The golf bag as recited in claim 22 and wherein said inner section has, as seen from a transverse view, a rectangular shape with rounded corners.

* * * * *